US011805857B2

(12) United States Patent
Yun

(10) Patent No.: US 11,805,857 B2
(45) Date of Patent: Nov. 7, 2023

(54) EASY LACING SYSTEM FOR ARTICLE OF FOOTWEAR

(71) Applicant: NIKE, Inc., Beaverton, OR (US)

(72) Inventor: Ben S. Yun, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/969,600

(22) Filed: Oct. 19, 2022

(65) Prior Publication Data

US 2023/0042947 A1 Feb. 9, 2023

Related U.S. Application Data

(63) Continuation of application No. 17/370,405, filed on Jul. 8, 2021, now Pat. No. 11,510,462.

(60) Provisional application No. 63/053,262, filed on Jul. 17, 2020.

(51) Int. Cl.
*A43C 11/20* (2006.01)

(52) U.S. Cl.
CPC ..... *A43C 11/20* (2013.01)

(58) Field of Classification Search
CPC .. A43C 11/20; A43C 7/00; A43C 1/02; A43C 1/06; A43C 1/00; A43B 23/26; Y10T 24/3703; Y10T 24/3724
See application file for complete search history.

(56) References Cited

U.S. PATENT DOCUMENTS 1,942,486 A * 1/1934 Miller ..... A43C 11/00 36/50.1
3,059,351 A * 10/1962 Hawkins ..... A43C 11/12 24/438
3,074,135 A * 1/1963 Brodowski ..... F16G 11/101 24/712.7
3,103,725 A * 9/1963 Robb ..... A43C 7/00 24/712.9
4,017,984 A * 4/1977 Bonfigli ..... G09B 19/0076 434/260
4,545,138 A * 10/1985 Blum ..... A43C 11/20 24/712.2
4,553,293 A * 11/1985 Blum ..... A43C 7/04 24/712.2
4,967,454 A * 11/1990 Elieff ..... A43C 7/00 24/712.1

(Continued)

*Primary Examiner* — Robert Sandy
*Assistant Examiner* — Rowland Do
(74) *Attorney, Agent, or Firm* — Quinn IP Law

(57) ABSTRACT

A closure mechanism for an article of footwear comprising a tongue, adjustable lace, toggle, and a tether is provided. The adjustable lace operatively connects the lateral sidewall and the medial sidewall along a throat opening, the tongue extends between the lateral sidewall and the medial sidewall within the throat opening, the toggle is coupled to and movable along the adjustable lace and fixedly attached to the tongue, and the tether is operatively coupled to each of the tongue and the toggle. The closure mechanism provides ease of use with a single motion, one-handed, transition from an open position to a tightened position by exerting a traction force in a predetermined direction on the adjustable lace, and from a tightened position to an open position by exerting a traction force in the predetermined direction on the tether. This disclosure may be particularly beneficial to wearers having limited dexterity or mobility.

20 Claims, 15 Drawing Sheets

(56) References Cited

U.S. PATENT DOCUMENTS 5,467,537 A * 11/1995 Aveni ..... A43C 11/00 24/712.1
5,469,640 A * 11/1995 Nichols ..... A43C 1/00 24/712.1
5,655,693 A * 8/1997 Engelman ..... A47G 25/82 223/118
5,671,505 A * 9/1997 Anscher ..... F16G 11/101 24/136 R
5,755,044 A * 5/1998 Veylupek ..... A43C 3/00 36/50.1
6,467,096 B1 * 10/2002 Coluccio ..... A42B 1/22 2/195.2
7,287,342 B2 * 10/2007 Keen ..... A43C 1/00 36/50.1
D586,648 S * 2/2009 Yoshie ..... D8/385
D615,391 S * 5/2010 Kawaguchi ..... D8/383
8,069,810 B2 * 12/2011 Petzl ..... F16G 11/101 24/3.2
8,904,605 B2 * 12/2014 Kawaguchi ..... F16G 11/03 D8/383
10,070,694 B2 * 9/2018 Schreiner ..... A43C 7/00
11,058,184 B2 * 7/2021 Yamamoto ..... A43C 1/06
2001/0007178 A1 * 7/2001 Pierre ..... A43B 5/0447 36/50.5
2001/0025434 A1 * 10/2001 Fellouhe ..... A43C 7/02 36/50.1
2002/0002781 A1 * 1/2002 Bouvier ..... A43B 23/26 36/50.1
2002/0078597 A1 * 6/2002 Burt ..... A43C 7/00 36/51
2003/0034365 A1 * 2/2003 Azam ..... A43C 11/20 223/113
2003/0041478 A1 * 3/2003 Liu ..... A43C 7/00 36/50.1
2004/0250445 A1 * 12/2004 Pritchett ..... A43B 3/16 36/2.6
2006/0179685 A1 * 8/2006 Borel ..... A43C 7/00 36/50.1
2007/0169382 A1 * 7/2007 Bongard ..... A43C 7/00 36/136
2008/0250618 A1 * 10/2008 Stramare ..... A43C 11/20 24/712.7
2010/0192411 A1 * 8/2010 Leick ..... F16G 11/101 24/713.2
2011/0099843 A1 * 5/2011 Jung ..... A43C 11/165 24/712
2013/0104346 A1 * 5/2013 Kawaguchi ..... F16G 11/101 24/115 G
2013/0205618 A1 * 8/2013 Martigny ..... A43B 3/0031 36/54
2013/0283639 A1 * 10/2013 Williams ..... A43C 7/02 36/83
2014/0366340 A1 * 12/2014 Park ..... A43C 7/08 24/712.2
2015/0181986 A1 * 7/2015 Chen ..... F16G 11/101 24/595.1

* cited by examiner

EASY LACING SYSTEM FOR ARTICLE OF FOOTWEAR

CROSS REFERENCE TO RELATED APPLICATIONS

This application is a continuation of U.S. Nonprovisional application Ser. No. 17/370,405, filed Jul. 8, 2021, which claims the benefit of U.S. Provisional Application No. 63/053,262, filed Jul. 17, 2020, and both of which are hereby incorporated by reference in their entirety.

TECHNICAL FIELD

The present disclosure generally relates to a closure mechanism for an article of footwear.

BACKGROUND

Articles of footwear generally include two primary elements, namely an upper and a sole structure. The sole structure is configured to be located under a wearer's foot, to space the foot away from the ground and to further provide stability and cushioning. The sole structure may include an outsole, a midsole, and an insole. In applications wherein a midsole, outsole, and insole are each present, the midsole may provide support and cushioning, the outsole may provide improved traction with the ground, and the insole may provide increased comfort for the foot.

A footwear upper may be attached to the sole structure and at least partially surround an interior volume that receives a foot of a wearer. The upper is often formed from a plurality of material elements (e.g., textiles, polymer sheet layers, foam layers, leather, synthetic leather) that are stitched or adhesively bonded together to form the interior volume. More particularly, the upper may form a structure that extends over the instep and toe areas of the foot, along medial and lateral sides of the foot, and around a heel area of the foot. In many designs, the upper may also incorporate a closure system to adjust the fit of the article of footwear, as well as permit entry of the foot into and removal of the foot from the interior volume.

SUMMARY

In general, the article of footwear may comprise a sole structure and an upper fixedly attached to the sole structure. The upper may comprise a lateral sidewall portion and a medial sidewall portion cooperating to define an interior volume therebetween. The upper may comprise a vamp and a heel counter portion, and the upper may further define an ankle opening with the ankle opening being operative to allow a wearer to extend a foot into the interior volume. A throat opening may extend from the ankle opening toward the vamp and between the lateral sidewall portion and the medial sidewall portion.

The upper may further include a closure mechanism configured to selectively adjust a maximum size of the ankle opening and the overall girth of the upper. The closure mechanism may include a tongue, an adjustable lace, a toggle, and a tether. The adjustable lace may have a first end and a second end operatively coupled at a pull tab. The adjustable lace may be fixedly attached to each of the lateral sidewall portion and the medial sidewall portion between the first end and the second end, such that the adjustable lace operatively connects the lateral sidewall portion and the medial sidewall portion along the throat opening.

The tongue extends between the lateral sidewall and the medial sidewall within the throat opening. The tongue having a first tongue portion attached to the upper at the vamp, a tongue distal edge, and a tongue body extending from the first tongue portion to the tongue distal edge.

The tether is operatively coupled to the tongue distal edge and the toggle. The tether forms a loop capable of receiving two or more human fingers.

The toggle is fixedly attached to the tongue body and is further coupled to and movable along the adjustable lace between a first position on the adjustable lace and a second position on the adjustable lace. When the toggle occupies the first position on the adjustable lace, the article of footwear is in an open position, which permits entry and removal of a foot of a wearer into the interior volume defined by the lateral side portion and the medial side portion of the upper. When the toggle occupies the second position on the adjustable lace, the article of footwear is in a tightened position, wherein a foot of a wearer is secured within the interior volume defined by the lateral side portion and the medial side portion of the upper.

Moving the toggle from the first position on the adjustable lace to the second position on the adjustable lace is facilitated by a single motion, one-handed, application of a traction force upon the pull tab in a predetermined direction. Moving the toggle from the first position on the adjustable lace to the second position on the adjustable lace, via the traction force on the pull tab, causes the adjustable lace to impart tension in each of the lateral sidewall portion and the medial sidewall portion as it moves through the toggle, when a foot is within the interior volume, and operatively reduces the size of the ankle opening, thereby transitioning the article of footwear from the open position to a tightened position about a foot of a wearer.

Moving the toggle from the second position on the adjustable lace to the first position on the adjustable lace is facilitated by a single motion, one-handed, application of a traction force upon the tether in the predetermined direction. Moving the toggle from the second position on the adjustable lace to the first position on the adjustable lace, via the traction force applied to the tether, causes the adjustable lace to release tension in each of the lateral sidewall portion and the medial sidewall portion as it moves through the toggle, when a foot is within the interior volume, and operatively increases the size of the ankle opening, thereby transitioning the article of footwear from the tightened position to the open position to allow for entry and or removal of the foot from the interior volume.

The single motion, one-handed, application of the traction force upon the pull tab to tighten and upon the tether to release the closure mechanism in the same predetermined direction allows the closure mechanism of the present invention to be particularly beneficial to wearer's having limited dexterity or mobility.

DETAILED DESCRIPTION

Figure 1:
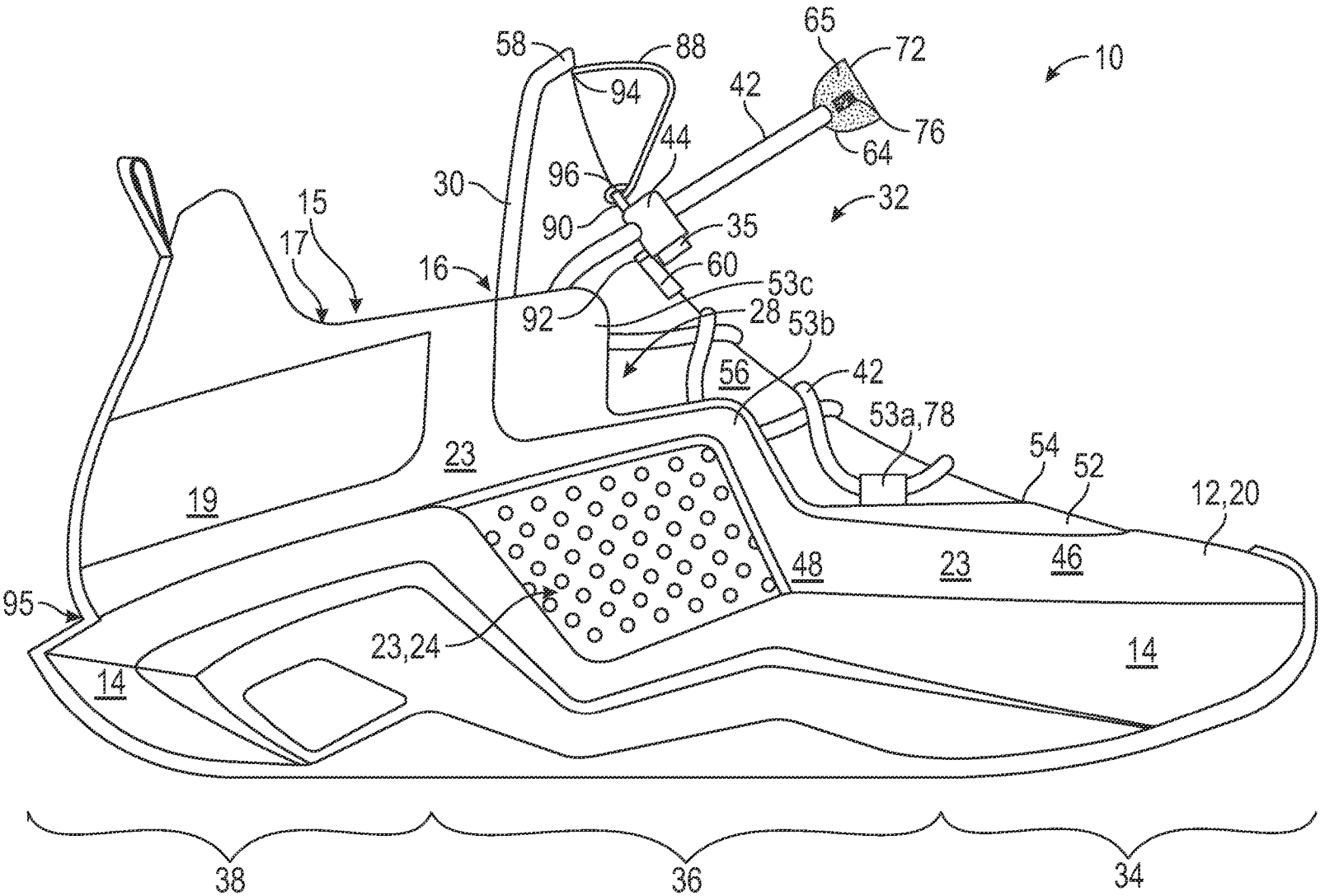
FIG. 1 is a schematic lateral side view of one example embodiment of an example athletic shoe having a closure mechanism comprising a tongue, an adjustable lace, a toggle, and a tether.

While the present disclosure may be described with respect to specific applications or industries, those skilled in the art will recognize the broader applicability of the disclosure.

The terms "a", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims. Any numerical designations, such as "first" or "second" are illustrative only and are not intended to limit the scope of the disclosure in any way.

The term "longitudinal", as used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse", as used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical", as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

In addition, the term "proximal" refers to a direction that is nearer a center of a footwear component or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

To assist and clarify the subsequent description of various embodiments, various terms are defined herein. Unless otherwise indicated, the following definitions apply throughout this specification (including the claims). An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

The following discussion and accompanying figures disclose various footwear configurations. Although the article of footwear 10 is depicted as athletic footwear configured for sports, such as sneakers, in the associated Figures, concepts associated with the configurations and methods may be applied to various other types of athletic footwear articles, such as hiking boots and shoes, soccer shoes, football shoes, running shoes, cross-training shoes, rugby shoes, basketball shoes, etc. However, the article of footwear 10 is not limited to sneakers or other sports shoes. In some embodiments, the disclosed provisions may be configured for use with various kinds of non-sports-related footwear, including but not limited to, boots, leisure shoes, dress shoes, work shoes, sandals, slippers, or any other category of footwear, which may also incorporate concepts discussed herein.

In a general sense, the present disclosure provides a closure mechanism 32 for an article of footwear 10 that provides ease of use for the wearer with a single motion, one-handed, transition from an open position 100 to a tightened position 200, as well as a single motion, one-handed, transition from the tightened position 200 to the open position 100. Such applications, while generally beneficial, may be particularly beneficial to wearer's having limited mobility and dexterity, including, but not limited to, young children, the elderly, and other wearers having limited mobility or dexterity, which causes difficulties in tying or otherwise securing traditional shoe laces and/or other closure mechanisms.

More particularly, the closure mechanism 32 may include a tongue 30, an adjustable lace 42, a toggle 44, and a tether 88. The adjustable lace 42 may have a first end 62 and a second end 64 operatively coupled at a pull tab 72. The adjustable lace 42 may be slidably attached to each of the lateral sidewall portion 24 and the medial sidewall portion 26 between the first end 62 and the second end 64, such that the adjustable lace 42 operatively connects the lateral sidewall portion 24 and the medial sidewall portion 26 along the throat opening 28. The toggle 44 is coupled to and moveable along the adjustable lace 42, in that the adjustable lace 42 is movable or slidable through the toggle 44, such that the toggle 44 is movable between a first position 300 on the adjustable lace 42 to a second position 400 on the adjustable lace 42. The toggle 44 is further fixedly attached to the tongue 30. The tether 88 is operatively coupled to the tongue 30 and the toggle 44 and forms a loop capable of receiving two or more human fingers.

Transitioning the article of footwear 10 from the open position 100 to the tightened position 200 is facilitated by a single motion, one-handed, application of a traction force upon the pull tab 72 in a predetermined direction D1. Transitioning the article of footwear 10 from the tightened position 200 to the open position 100 is facilitated by a single motion, one-handed, application of a traction force upon the tether 88 in the predetermined direction D1.

The single motion, one-handed, application of a traction force upon the pull tab 72 to tighten and upon the tether 88 to release the closure mechanism 32 allows wearer's having limited dexterity or mobility to tighten and release their own footwear 10 with limited fine motor use of the hands and fingers, as well as reduced required traction force. The single motion, one-handed, application of the traction force upon the pull tab 72 to tighten and upon the tether 88 to release the closure mechanism 32 also allows parents, teachers, guardians, and other caregivers to secure and/or remove the footwear from a patient, young child, or other charge in a simple motion with the use of only one hand.

Referring to the drawings, wherein like reference numerals refer to like components throughout the several views, an article of footwear 10 is provided. As shown in FIGS. 1-10C, the article of footwear 10 comprises an upper 12 fixedly attached to a sole structure 14.

The upper 12 is a portion of the article of footwear 10 that defines an interior volume or cavity 16 adapted to receive a foot of a wearer. For the purpose of consistency and clarity, the "interior" of the article of footwear 10 refers to space that is occupied by a wearer's foot when the article of footwear 10 is worn. The "inner side" of the upper 12 or other shoe element refers to the face of that panel or element that is (or will be) oriented toward the interior in a completed article of footwear 10. The "outer side" or "exterior" of an element refers to the face of that element that is (or will be) oriented away from the interior in a completed article of footwear 10.

Figure 2:
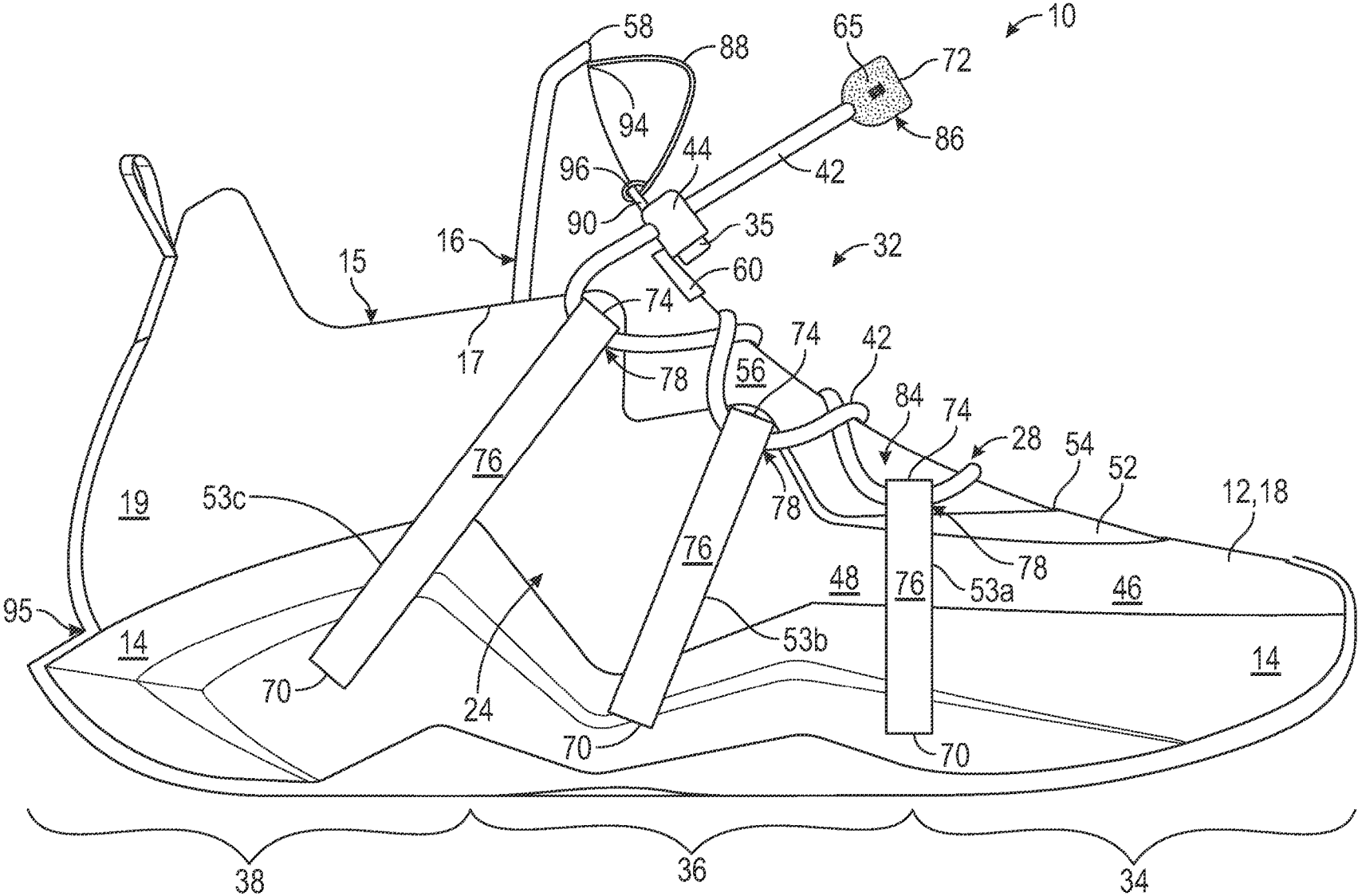
FIG. 2 is a schematic lateral side view of an example embodiment of an example athletic shoe having a closure mechanism comprising a tongue, an adjustable lace, a toggle, and a tether, wherein the outer layer of the upper is removed to illustrate the inner layer of the lateral sidewall portion.
Figure 3:
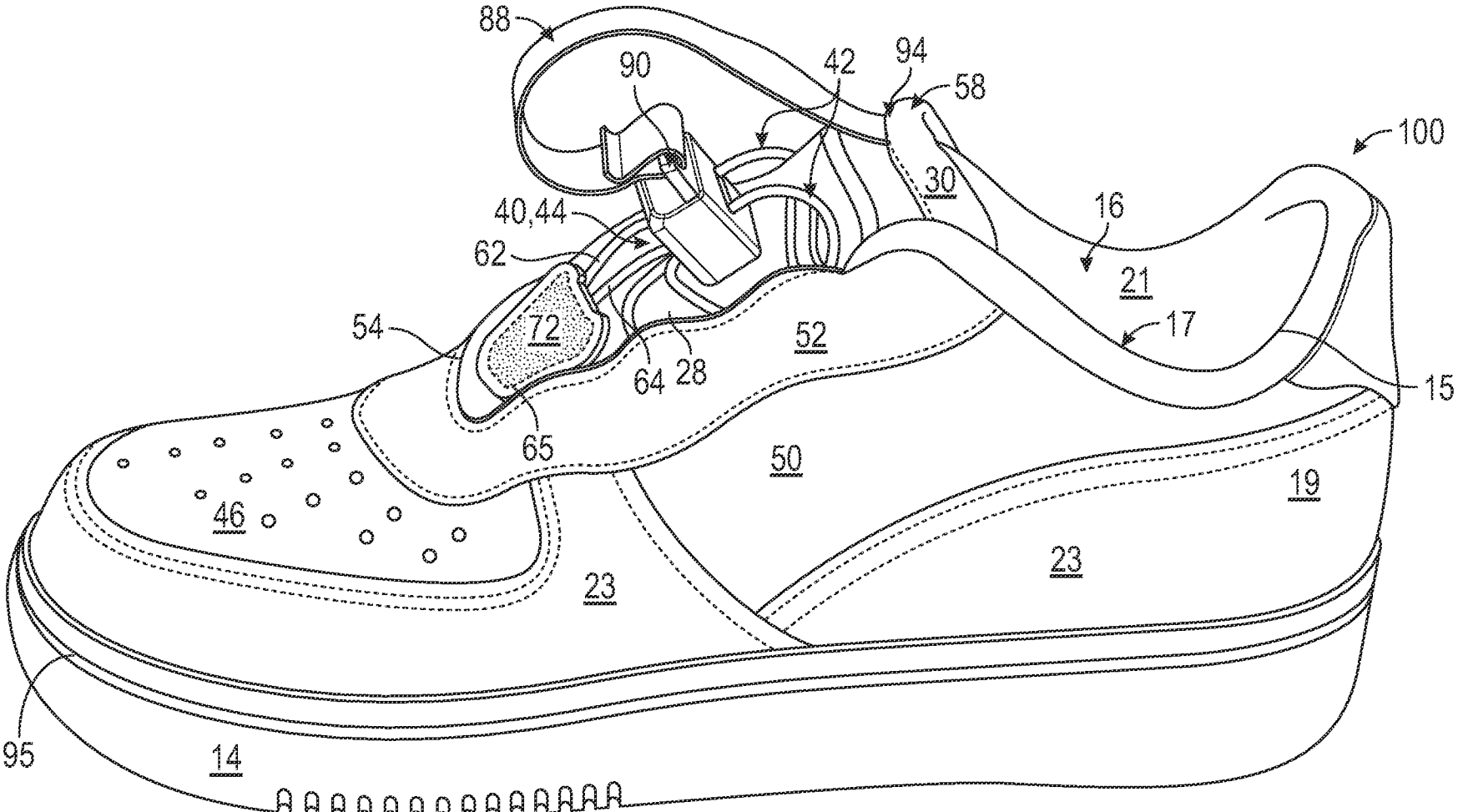
FIG. 3 is a lateral side view of another example embodiment of an example athletic shoe, wherein the toggle is in the first position on the adjustable lace and the article of footwear is in the open position.

As indicated in FIGS. 1-2, the article of footwear 10 may be divided into a forefoot region 34, a midfoot region 36, and a heel region 38, which are likewise the forefoot region 34, the midfoot region 36, and the heel region 38, of the sole structure 14 and the upper 12 respectively. The forefoot region 34 generally includes portions of the article of footwear 10 corresponding with the toes and the joints connecting the metatarsals with the phalanges. The midfoot region 36 generally includes portions of the article of footwear 10 corresponding with the arch area and instep of the foot. The heel region 38 corresponds with rear portions of the foot, including the calcaneus bone. The forefoot region 34, the midfoot region 36, and the heel region 38 are not intended to demarcate precise areas of the footwear 10 but are instead intended to represent general areas of the footwear 10 to aid in the following discussion.

The article of footwear 10 further has a lateral sidewall portion 24 (FIGS. 1-4, 8C, 10A-10C) and a medial sidewall portion 26 (FIGS. 4, 8A-8D, 10A-10C). The lateral sidewall portion 24 and medial sidewall portion 26 extend through each of the forefoot region 34, the midfoot region 36, and the heel region 38, and correspond with opposite sides of the article of footwear 10, each falling on an opposite side of a longitudinal midline LM of the article of footwear 10, partially indicated in FIG. 10A. The medial sidewall portion 26 is thus considered opposite to the lateral sidewall portion 24.

The sole structure 14 may include provisions for attenuating ground reaction forces (i.e., cushioning and stabilizing the foot during vertical and horizontal loading). In addition, sole structure 14 may be configured to provide traction, impart stability, and control or limit various foot motions, such as pronation, supination, or other motions. For example, the disclosed concepts may be applicable to footwear configured for use on any of a variety of surfaces, including indoor surfaces or outdoor surfaces. In some embodiments, the sole structure 14 may be configured to provide traction and stability on hard indoor surfaces (such as hardwood); soft, natural turf surfaces; or on hard, artificial turf surfaces.

In different embodiments, the sole structure 14 may include different components, which may, individually or collectively, provide an article 10 with a number of attributes, such as support, rigidity, flexibility, stability, cushioning, comfort, reduced weight, or other attributes. For example, the sole structure 14 may include a midsole, an outsole, and a cushioning layer and/or insole. The compressible polymer element of the sole structure 14 attenuates ground reaction forces (i.e., provides cushioning) when compressed between the foot and the ground during walking, running, or other ambulatory activities, and may be formed from a compressible polymer element, such as a thermoset or a thermoplastic, for example, a cross-linked thermosetting plastic, a cross-linked thermosetting resin, or a crosslinked thermosetting elastomer (e.g., rubber), a polyurethane foam, ethylvinylacetate (EVA) foam, an ionomeric polymer foam, or the like. In further configurations, the midsole may incorporate fluid-filled chambers, plates, moderators, or other elements that further attenuate forces, enhance stability, or influence the motions of the foot.

The midsole may be a single, one-piece midsole, or could be multiple components integrated as a unit. In some embodiments, the midsole may be integrated with the outsole as a unisole. The outsole may be one-piece, or may be several outsole components, and may be formed from a wear-resistant rubber material that may be textured to impart traction and/or may include traction elements such as cleats secured to the midsole.

When the foot is positioned within the foot-receiving interior cavity 16 of the article of footwear 10, the foot is supported on a foot-facing surface of the midsole. Optionally, the foot-facing surface of the midsole may be covered by a strobel secured to a lower region of the upper 12. Also, optionally, an insole may rest on the strobel or directly on the sole structure 14 in embodiments without a strobel, in which case the foot is supported by both the sole structure 14 and the insole.

It may be appreciated, however, that the sole structure 14 is not limited to incorporating traditional sole components and may incorporate various different kinds of elements arranged at the outermost, innermost, and intermediate 'layers', or locations, of the sole. Thus, the sole structure 14 can include an outer sole member or element, which may or may not coincide with a conventional 'outsole'. Likewise, the sole structure 14 may include an inner sole member or element, which may or may not be an 'insole'. Further, the sole structure 14 can include any number of intermediate and/or middle sole members or elements, which may or may not be a 'midsole'.

The sole structure 14 may be permanently and/or fixedly attached to one or more portions of the upper 12 (for example, with adhesive, stitching, welding, or other suitable techniques) at a bite line 95 and may have a configuration that extends between the upper 12 and the ground. For purposes of this disclosure, the term "permanently attached" shall refer to two components joined in a manner such that the components may not be readily separated (for example, without destroying one or both of the components). In addition, two components may be "permanently attached" by virtue of being integrally formed, for example, through a molding process.

In general, the upper 12 includes provisions to reduce any tendency of the foot to be pulled away from the sole structure 14 during use. In some embodiments, the upper 12 may be a conventional upper defining and at least partially surrounding an interior volume or cavity 16 for receiving a foot of a wearer. The upper 12 may be formed of a variety of materials, such as leather, textiles, polymers, cotton, foam, composites, etc. The upper 12 may be comprised of a material that has elasticity, breathability, or both in order to aid with foot insertion and comfort. For example, the upper 12 may be a polymeric material or textile material capable of providing elasticity, and may be of a braided construction, a knitted (e.g., warp-knitted) construction, or a woven construction. The upper 12 may include multiple layers including but not limited to an inner layer 18 and an outer layer 20. The inner layer 18 may be comprised of a material that has elasticity, breathability, or both in order to aid with foot insertion and comfort. The inner layer 18 may define an interior upper surface 21 that contacts the wearer's foot. The upper 12 may further include an outer layer 20 formed of a variety of materials, such as leather, textiles, polymers, cotton, foam, composites, etc. The outer layer 20 may define an exterior upper surface 23 opposite the interior upper surface 21 that comprises the exterior of the upper 12.

In other embodiments, the upper 12 may be configured to provide a 'tension fit' about a wearer's foot. As used herein, the term tension fit refers to a fit that ensures the upper 12 is pulled against the foot at all times including on a lower side where the sole of the foot contacts a bottom portion of the upper 12. In some cases, a tension fit upper may be configured so that when no foot is present within the interior cavity 16, the interior cavity 16 has a volume that is smaller than the volume after a foot has been inserted. In other words, the upper 12 may be configured to stretch or expand as a foot is inserted. Such a configuration may provide an upper 12 that 'stays with' the foot, and especially the sole of the foot, at all times during any activities (e.g., running, jumping, walking, etc.). A tension fit may or may not require stretching in the upper 12. In some cases, the upper 12 can be configured to stretch significantly when a foot is inserted. In other cases, however, the upper 12 may simply fit the foot very snugly without significant expansion.

The upper 12 defines the lateral sidewall portion 24 and medial sidewall portion 26, and the lateral sidewall portion 24 and the medial sidewall portion 26 cooperate to define the interior volume 16 therebetween. The upper 12 may further define a vamp 46 that extends into the forefoot region 34 and the midfoot region 36 on each of the lateral sidewall portion 24 and the medial sidewall portion 26 of the upper 12. The upper 12 may further define a lateral quarter 48 and a medial quarter 50, which abut the vamp 46 and extend into the midfoot region 36 of the respective lateral sidewall portion 24 and medial sidewall portion 26 of the upper 12. The upper 12 may still further define a heel counter 19 which is positioned in the heel region 38 between the bite line 95 and an ankle collar portion 17.

The ankle collar portion 17 of the article of footwear 10 defines and borders an ankle opening 15. The ankle opening 15 is operative to allow a wearer to extend a foot into the interior volume 16 defined by the upper 12. When a foot is present within the interior volume 16, the ankle collar portion 17 extends circumferentially around the wearer's ankle and may provide additional lateral support. The ankle opening 15 may have a maximum size, which may be operatively reduced via actuation of the closure mechanism 32.

The throat opening 28 may be disposed between the lateral sidewall portion 24 and the medial sidewall portion 26 and extend from the ankle opening 15 toward the vamp 46 and between the lateral sidewall portion 24 and the medial sidewall portion 26. The throat opening 28 may be an extension of the ankle opening 15 and may further permit access of a wearer's foot into the interior cavity 16 of the upper 12. The throat opening 28 may be bordered or surrounded by an eye stay reinforcement 52.

Referring to FIGS. 1-4, 8A-8D, and 10A-10C, the closure mechanism 32 may be positioned over and/or across the throat opening 28 and may comprise a securing mechanism such as an adjustable lace 42 or the like. The closure mechanism 32 may couple the lateral sidewall portion 24 and the medial sidewall portion 26, while providing an ability to adjust the girth of the upper 12 and the maximum size of the ankle opening 15. The closure mechanism 32 may generally include an adjustable lace 42, a plurality of guide elements 53*a*, 53*b*, 53*c*, 55*a*, 55*b*, 55*c*, a toggle 44, and a tether 88. The closure mechanism 32 may also include, in some embodiments, a unitary closure panel or tongue portion 30, in other embodiments, such as those having 'tension fit' upper construction, the closure mechanism 32 may not include a unitary closure panel or tongue portion 30.

The tongue portion 30 may extend over the instep region of the foot. The tongue portion 30 may be integrated with or separately secured at the vamp 46. Further, the tongue portion 30 may have a first tongue portion 54 secured or fixedly attached at the vamp 46 and a tongue distal edge 58. The tongue portion 30 may further define a tongue body 56 extending within the throat opening 28 between the lateral sidewall portion 24 and the medial sidewall portion 26 from the first tongue portion 54 to the tongue distal edge 58.

Figure 4:
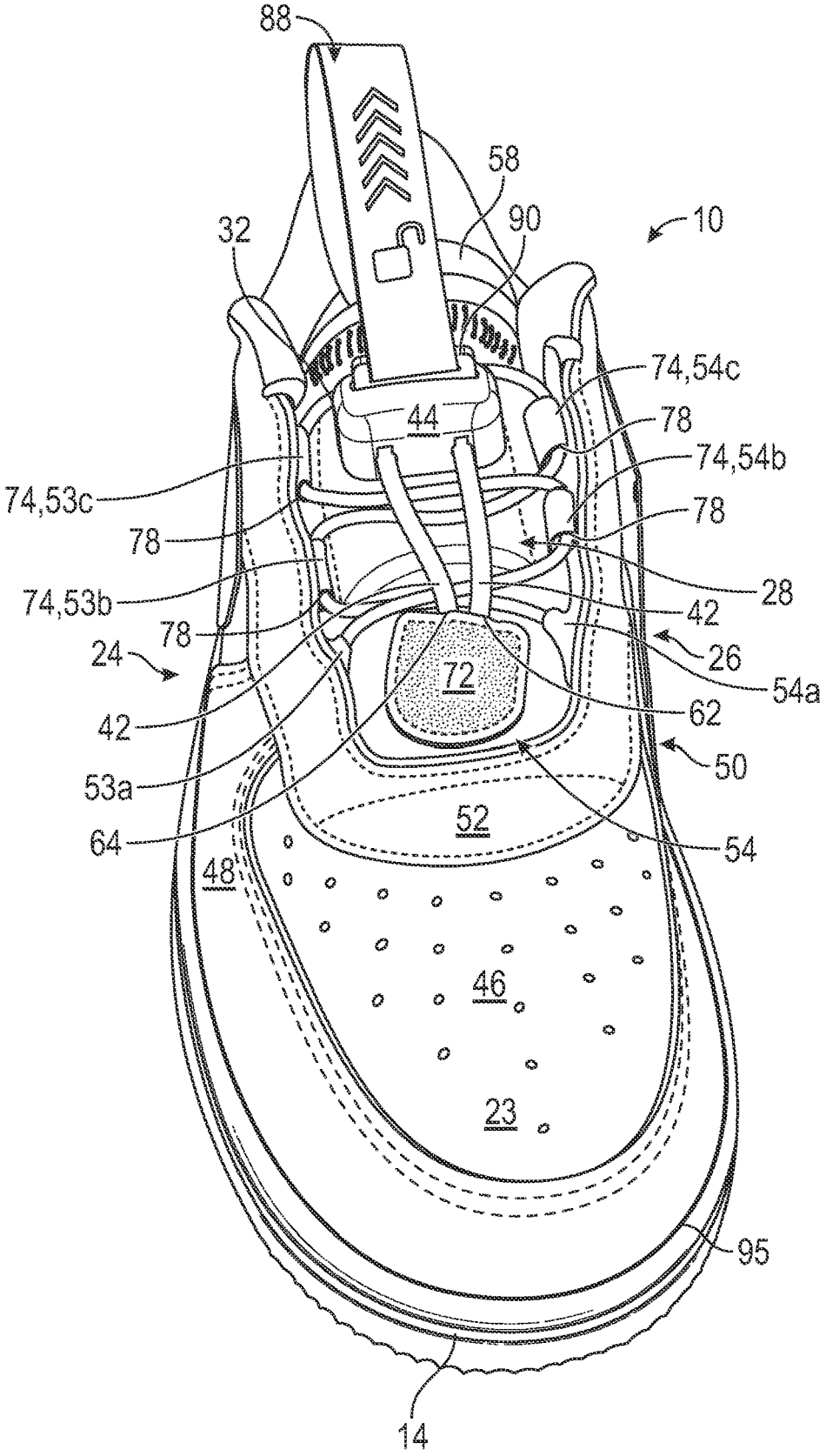
FIG. 4 is a top perspective view of the example embodiment of FIG. 3, wherein the toggle is in the first position on the adjustable lace and the article of footwear is in the open position.
Figure 10A:
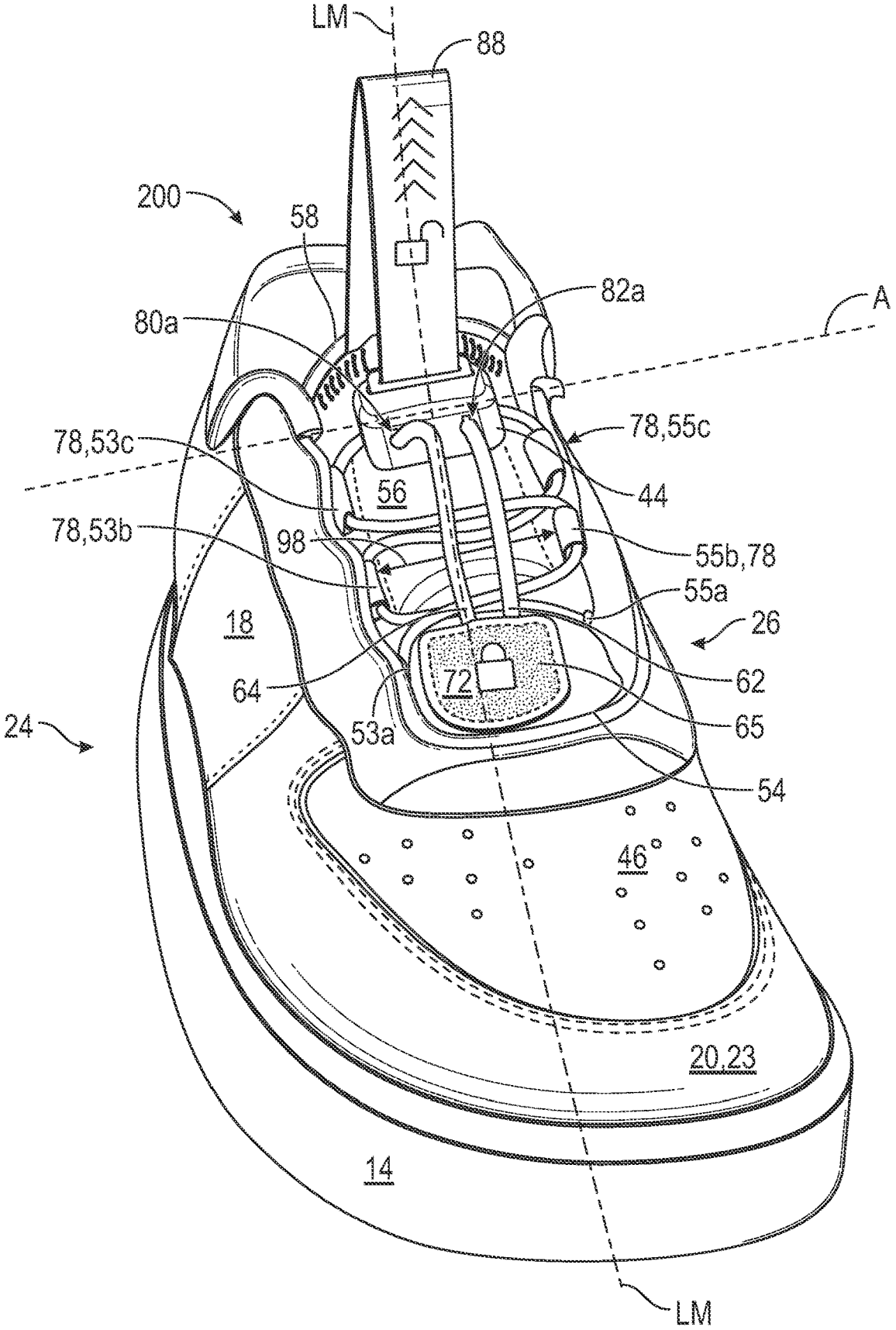
FIG. 10A a perspective top view of the example embodiment of FIG. 3, wherein the toggle is in the second position on the adjustable lace and the example shoe is in the tightened position before traction is applied to the tether.

As best illustrated in FIGS. 2, 4, 10A the closure mechanism 32 may further include the plurality of guide elements 53*a*, 53*b*, 53*c*, 55*a*, 55*b*, 55*c*. Each of the guide elements 53*a*, 53*b*, 53*c*, 55*a*, 55*b*, 55*c* may comprise a semi-stretchable material, such as a textile webbing or the like. Each of the guide elements 53*a*, 53*b*, 53*c*, 55*a*, 55*b*, 55*c* further comprising an anchor end 70, a loop end 74, and a strap portion 76. The anchor end 70 is fixedly attached to the sole structure 14 at the bite line 95. The loop end 74 is disposed opposite the anchor end 70 and defines a guide loop 78 positioned in the throat opening 28. The strap portion 76 is disposed between the anchor end 70 and the loop end 74 and extends from the anchor end 70 to the guide loop 78. The strap portion 76 is disposed between the inner layer 18 and the outer layer 20 of the upper 12 from the anchor end 70 to the loop end 74. The loop end 74 is fixedly attached to the upper interior surface 21 at the throat opening 28, such that the guide loop 78 extends into the throat opening 28.

The plurality of guide elements may include a plurality of lateral side guide elements 53*a*, 53*b*, 53*c* integral to the lateral side wall portion 24, e.g. disposed between the inner layer 18 and the outer layer 20 of the lateral sidewall portion 24, and a plurality of medial side guide elements 55*a*, 55*b*, 55*c* integral to the medial sidewall portion 26, e.g. disposed between the inner layer 18 and the outer layer 20 of the medial sidewall portion 26. The plurality of lateral side guide elements 53*a*, 53*b*, 53*c* may comprise any number of lateral side guide elements, and the plurality of medial side guide elements 55*a*, 55*b*, 55*c* may comprise any number of medial side guide elements. However, the number of lateral side guide elements 53*a*, 53*b*, 53*c* in many cases is substantially equal to the number of medial side guide elements 55*a*, 55*b*, 55*c*.

In one example, the plurality of lateral side guide elements 53*a*, 53*b*, 53*c* may include at least a first lateral side guide element 53*a*, a second lateral side guide element 53*b*, and a third lateral side guide element 53*c*. The anchor end 70 of the first lateral side guide element 53*a* may be fixedly attached to the sole structure 14 at the bite line 95 in the vamp 46. The loop end 74 of the first lateral side guide element 53*a* may be fixedly attached to the upper interior surface 21 of the lateral sidewall portion 24 at the throat opening 28 and is further disposed closer to the vamp 46 than the ankle opening 15. The anchor end 70 of the second lateral side guide element 53*b* may be fixedly attached to the sole structure 14 at the bite line 95 in the lateral quarter portion 48 between the vamp 46 and the heel counter portion 19. The loop end 74 of the second lateral side guide element 53*b* may be fixedly attached to the upper interior surface 21 of the lateral sidewall portion 24 at the throat opening 28 and is further disposed between the loop end 74 of the first lateral guide element 53*a* and the ankle opening 15. The anchor end 70 of the third lateral side guide element 53*c* may be fixedly attached to the sole structure 14 at the bite line 95 in the heel counter portion 19. The loop end 74 of the third lateral side guide element 53*c* may be fixedly attached to the upper interior surface 21 of the lateral sidewall portion 24 at the throat opening 28 and is further disposed between the loop end 74 of the second lateral guide element 53*b* and the ankle opening 15.

Analogously, in the respective example, the plurality of medial side guide elements 55*a*, 55*b*, 55*c* may include at least a first medial side guide element 55*a*, a second medial side guide element 55*b*, and a third medial side guide element 55*c*. The anchor end 70 of the first medial side guide element 55*a* may be fixedly attached to the sole structure 14 at the bite line 95 in the vamp 46. The loop end 74 of the first medial side guide element 55*a* may be fixedly attached to the upper interior surface 21 of the medial sidewall portion 24 at the throat opening 28 and is further disposed closer to the vamp 46 than the ankle opening 15. The anchor end 70 of the second medial side guide element 55*b* may be fixedly attached to the sole structure 14 at the bite line 95 in the medial quarter portion 48 between the vamp 46 and the heel counter portion 19. The loop end 74 of the second medial side guide element 55*b* may be fixedly attached to the upper interior surface 21 of the medial sidewall portion 24 at the throat opening 28 and is further disposed between the loop end 74 of the first medial guide element 55*a* and the ankle opening 15. The anchor end 70 of the third medial side guide element 55*c* may be fixedly attached to the sole structure 14 at the bite line 95 in the heel counter portion 19. The loop end 74 of the third medial side guide element 55*c* may be fixedly attached to the upper interior surface 21 of the medial sidewall portion 24 at the throat opening 28 and is further disposed between the loop end 74 of the second medial guide element 53*b* and the ankle opening 15.

Further, the loop end 74 of the third lateral guide element 53*c* is disposed in the ankle collar portion 17 of the lateral sidewall portion 24 and the loop end 74 of the third medial guide element 55*c* is disposed in the ankle collar portion 17 of the medial sidewall portion 24. Said another way, the loop end 74 and the guide loop 78 of the third lateral guide element 53*c* and the loop end 74 and guide loop 78 of the third medial guide element 55*c* are each positioned on an alignment axis A (FIG. 10A) that is substantially orthogonal to the longitudinal midline LM.

The closure mechanism 32 may further comprise an adjustable lace 42 (FIGS. 1-4, 7, 8A-8D, 10A-10C). The adjustable lace 42 may be a single element adjustable lace 42, having a lace first end 62 and a lace second end 64 that is operatively coupled to the first lace end 62 at a pull tab 72. The adjustable lace 42 is further operatively coupled to each of the lateral sidewall portion 24 and the medial sidewall portion 26 between the first end 62 and the second end 64 and further configured to operatively connect the lateral sidewall portion 24 and the medial sidewall portion 26 along the throat opening 28. In this way, the guide loops 78 of each of the plurality of lateral side guide elements 53*a*, 53*b*, 53*c* are configured to receive the adjustable lace 42 therein to thereby operatively couple the adjustable lace 42 to the lateral sidewall portion 24. Analogously, the guide loops 78 of each of the plurality of medial side guide elements 55*a*, 55*b*, 55*c* are configured to receive the adjustable lace 42 therein to thereby operatively couple the adjustable lace 42 to the medial sidewall portion 26. The adjustable lace 42 alternately passes through one of the lateral side guide elements 53*a*, 53*b*, 53*c* and one of the medial side guide elements 55*a*, 55*b*, 55*c* traversing the throat opening 28 therebetween.

Figure 7:
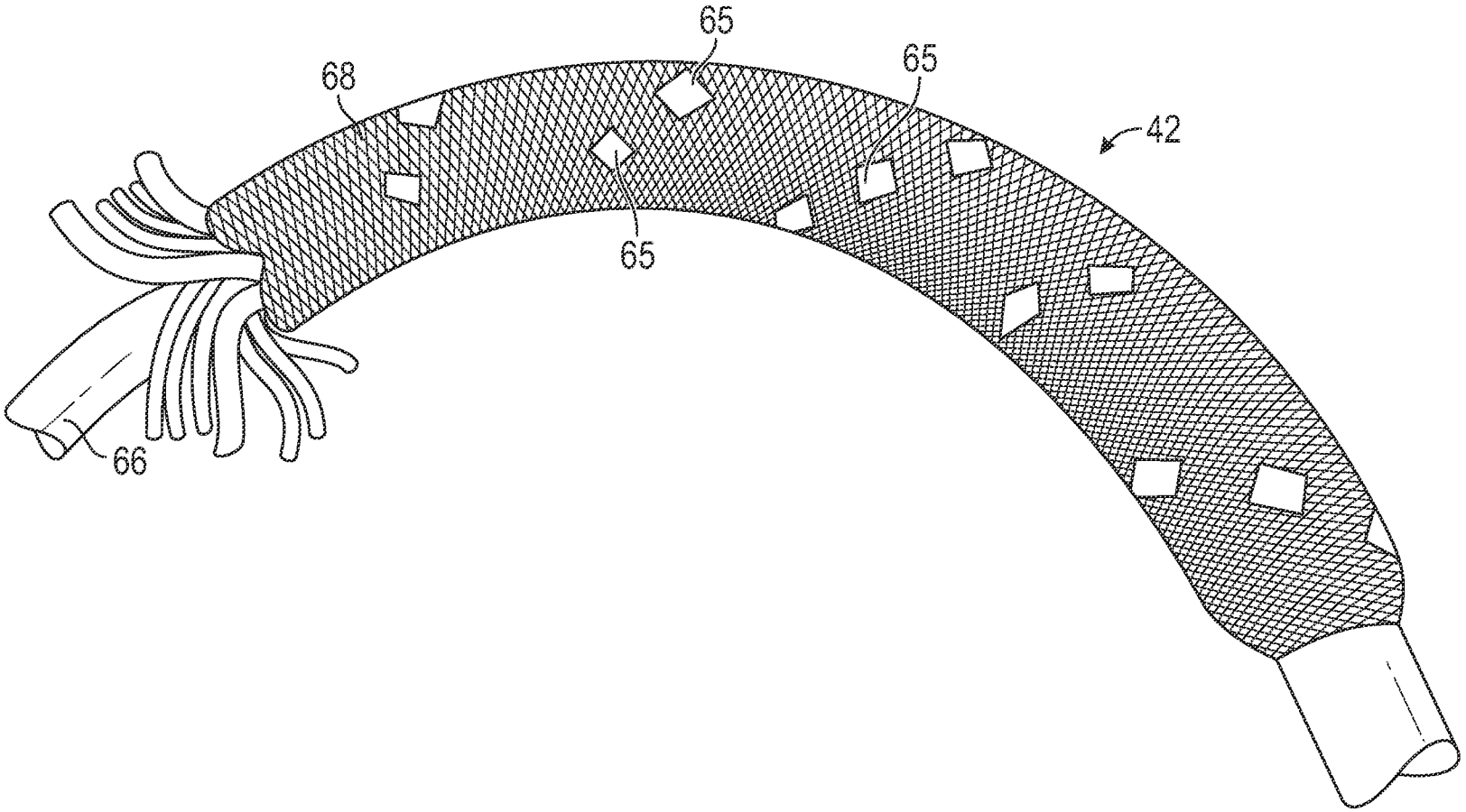
FIG. 7 is a schematic perspective view of an example adjustable lace.

As best illustrated in FIG. 7, the adjustable lace 42 may comprise a textile or fabric material, elastomeric material, polymeric materials, or the like and may be embodied as a lace, cord, or the like. More particularly, the adjustable lace 42 may comprise a stretchable material. In one example, the adjustable lace 42 may comprise a fully elastomeric material. In yet another example, the adjustable lace 42 may comprise a mixture of elastomeric materials and non-elastomeric materials. In one example embodiment, the adjustable lace 42 further comprises an elastomeric core 66 to permit the adjustable lace 42 to stretch between the first end 62 and the second end 64. In such an embodiment, the adjustable lace 42 may further comprise a woven cover 68 disposed about the elastomeric core 66, wherein the woven cover 68 is a textile woven cover 68 having elastic or stretchable properties. Still further, the adjustable lace 42 may further comprise a frictional coating 65 (FIGS. 7 and 8B) disposed on select portions of the woven cover 68.

As best illustrated in FIGS. 1-4, 8A-8D, and 10A-10C, the pull tab 72 may comprise an easily graspable and easily grippable singular end point for the adjustable lace 42, which couples the first lace end 62 and the second lace end 64. The pull tab 72 may comprise a variety of materials, such as leather, textiles, polymers, cotton, foam, composites, etc. and may be further coated with a frictional coating 65 to enhance the grip characteristics of the pull tab 72. In one embodiment, the pull tab 72 may comprise a Thermoplastic Polyurethane (TPU) material. In another example embodiment, the pull tab 72 may comprise an Acrylonitrile butadiene styrene (ABS) plastic material.

Figure 8A:
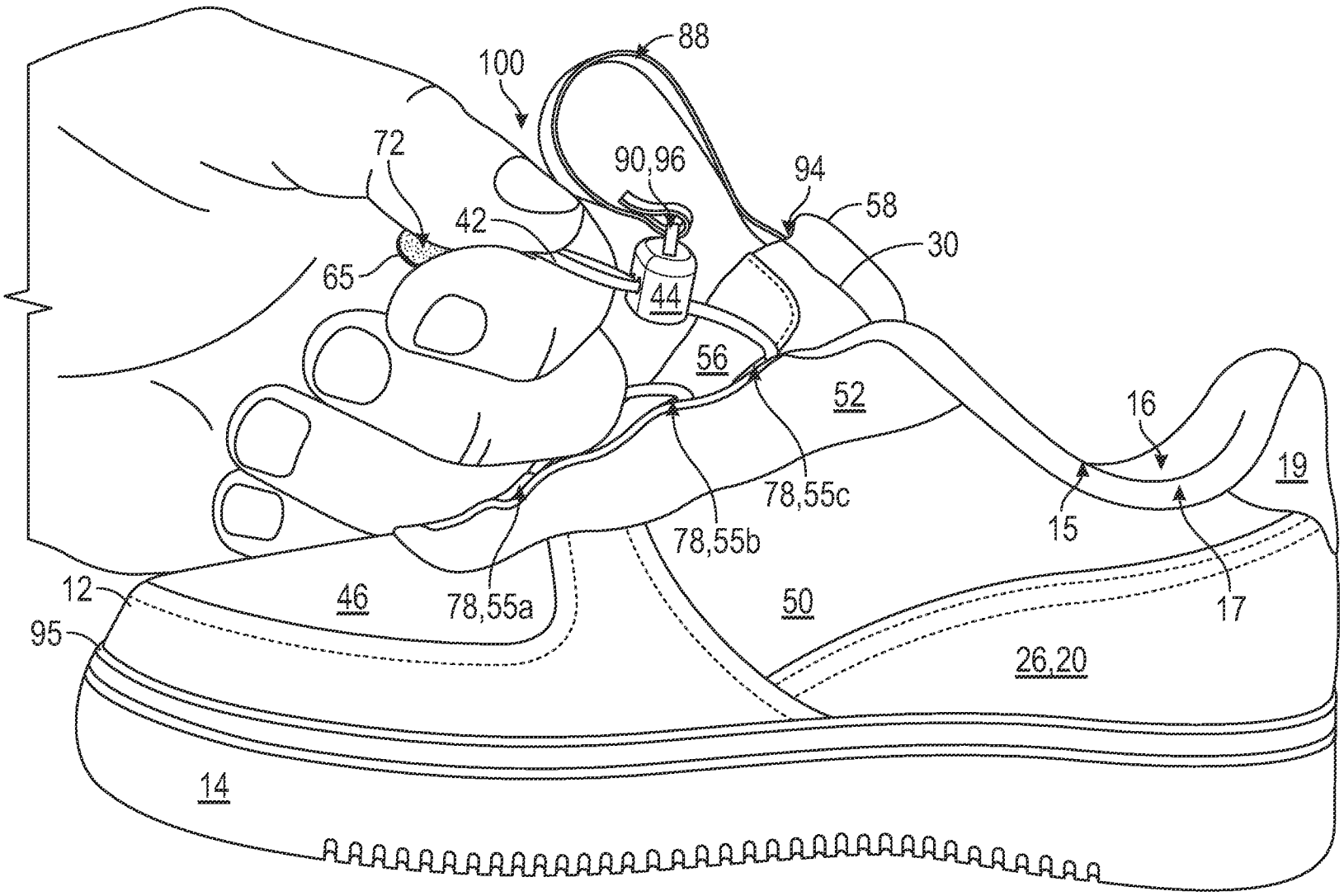
FIG. 8A is a medial side view of the example embodiment of FIG. 3, wherein the toggle is in the first position on the adjustable lace and the example shoe is in the open position before a traction is applied to the pull tab in the predetermined direction.
Figure 8B:
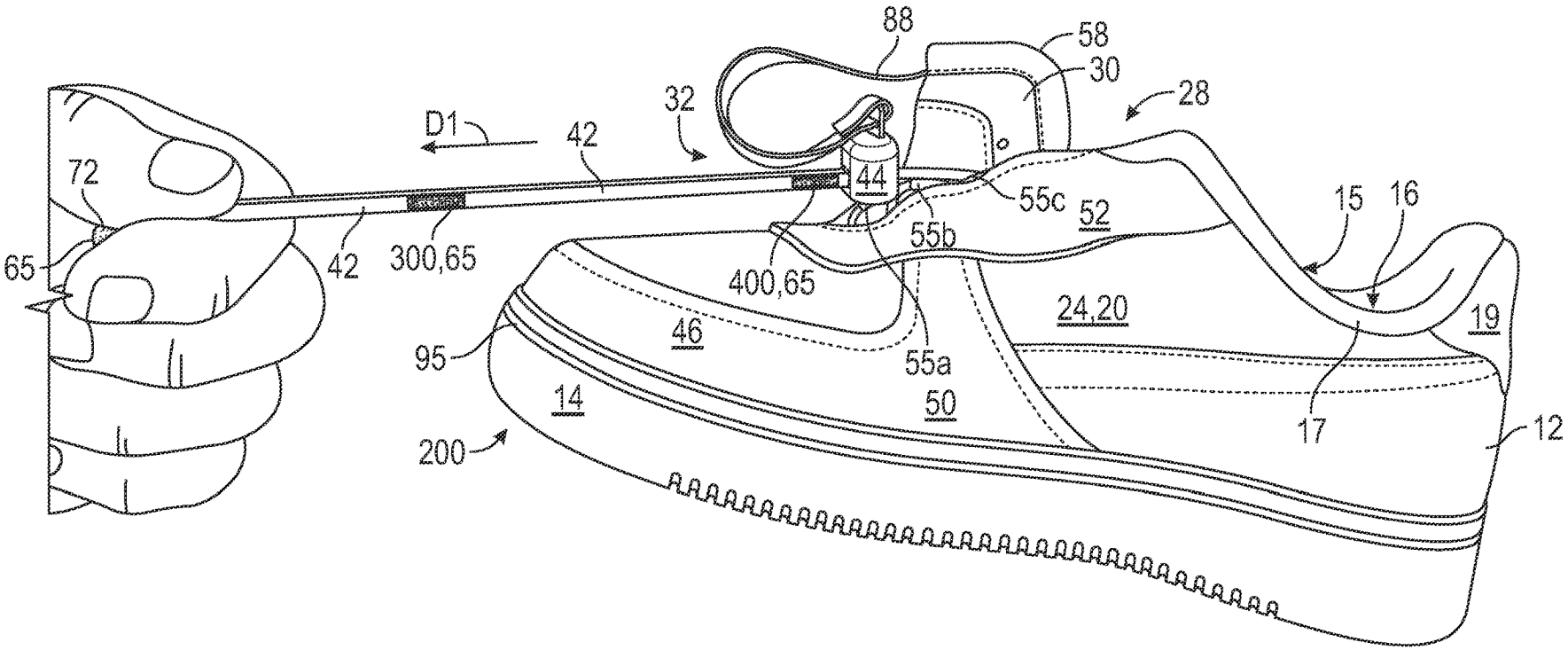
FIG. 8B is a medial side view of the example embodiment of FIG. 3, wherein the toggle is in the second position on the adjustable lace and the example shoe is being transitioned from the first position on the adjustable lace to the second position on the adjustable lace via a traction force applied to the pull tab in the predetermined direction.
Figure 8C:
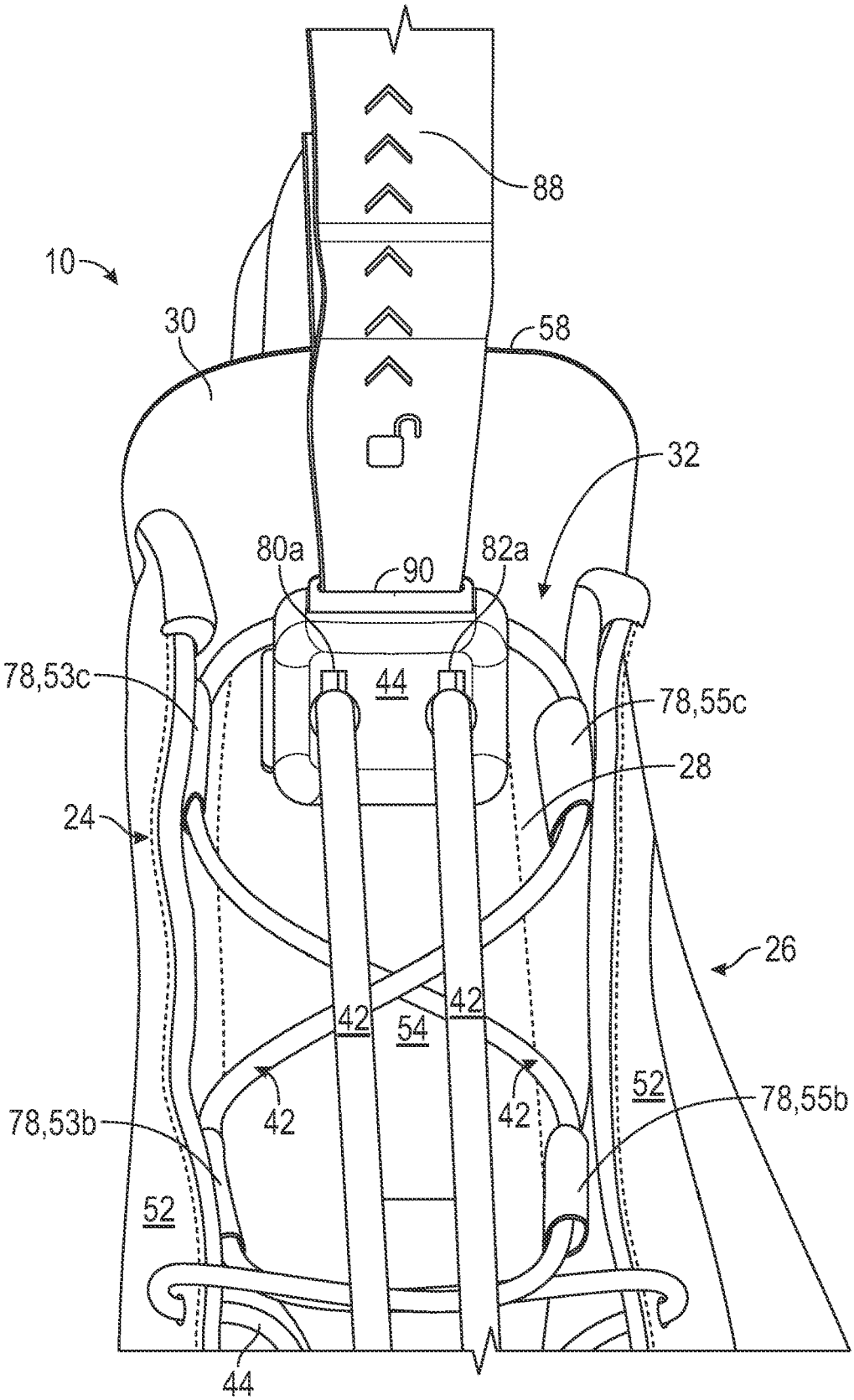
FIG. 8C is a top perspective view of the example embodiment of FIG. 3, wherein the toggle is in the second position on the adjustable lace and the example shoe is being transitioned from the first position on the adjustable lace to the second position on the adjustable lace via a traction force applied to the pull tab in the predetermined direction.
Figure 8D:
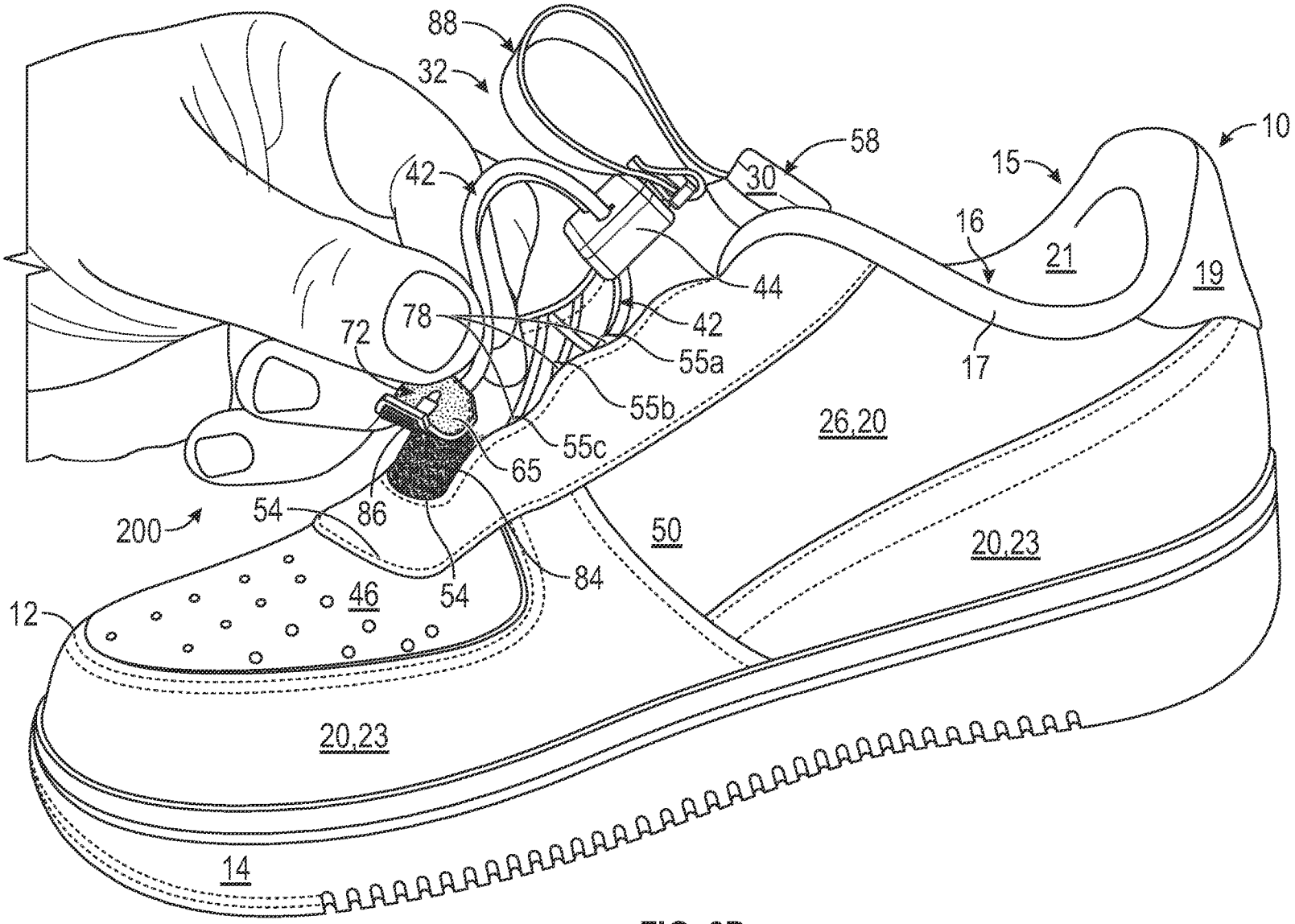
FIG. 8D is a medial side view of the example embodiment of FIG. 3, wherein the toggle is in the second position on the adjustable lace and the example shoe is in the tightened position, with the pull tab being fastened to the tongue via a coupling feature.
Figure 9:
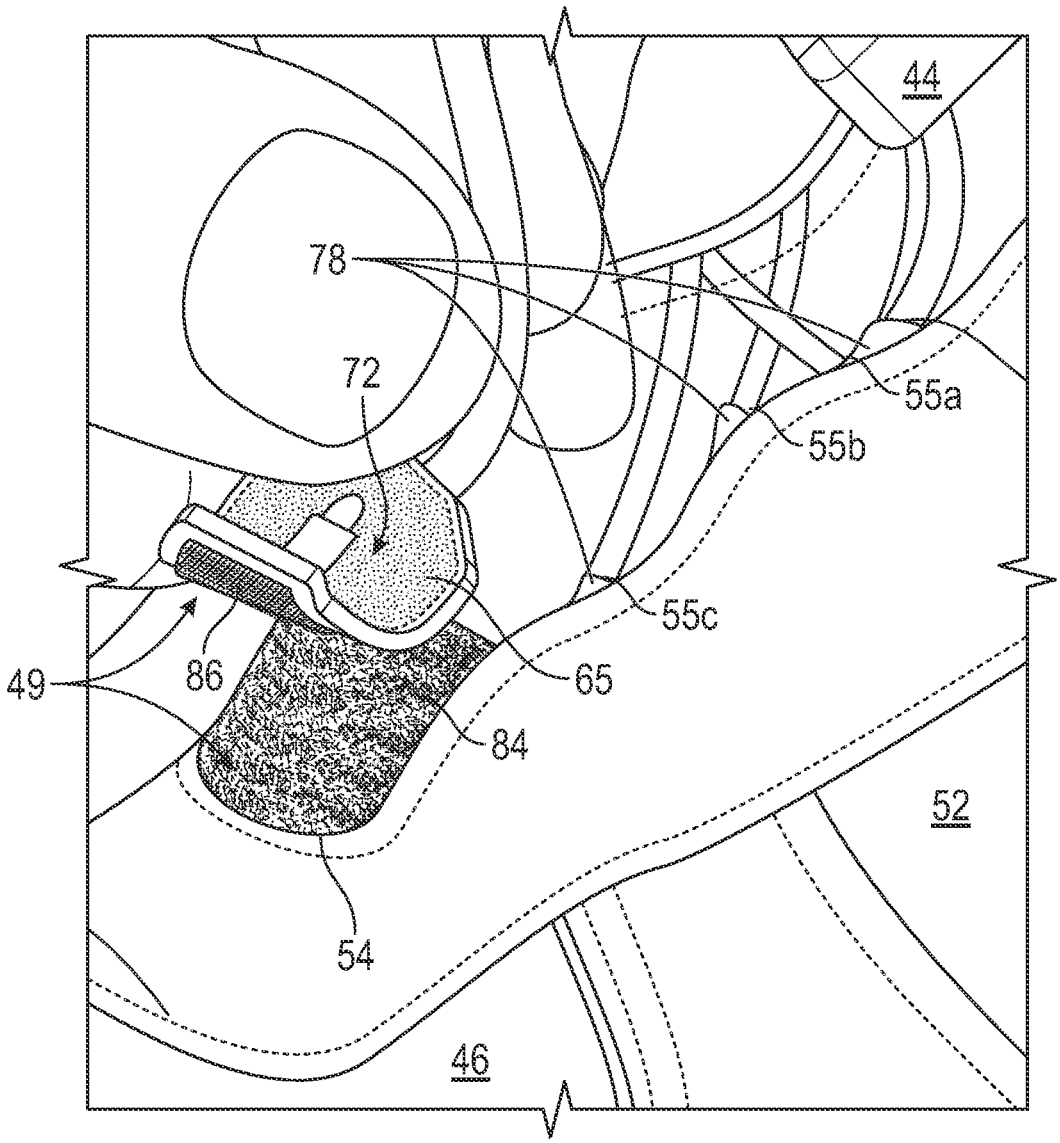
FIG. 9 is an enlarged portion of FIG. 8D showing the coupling feature in greater detail.

As shown in FIGS. 8D, and 9, a coupling feature 49 may be configured to mechanically engage the pull tab 72 with the tongue body 56 when the pull tab 72 is not in use and to secure the pull tab 72 to the upper 12. The coupling feature 49 may comprise a first portion 84 coupled to the tongue body 56 and a second portion 86 coupled to the pull tab 72. The coupling feature 49 may comprise a hook and loop fastener, wherein the first portion 84 comprises at least one of fabric hooks or fabric loops, and wherein the second portion 86 comprises the other one of fabric hooks or fabric loops.

The closure mechanism 32 may further include a toggle 44 operatively coupled to and slidable along the adjustable lace 42. The toggle 44 may be positioned on the adjustable lace 42 between the pull tab 72 and the guide loop 78 of the third lateral guide element 53*c* and between the pull tab 72 and the guide loop 78 of the third medial side guide element 55*c*. The toggle 44 is further moveable along the adjustable lace 42 between a first position 300 and a second position 400 (FIG. 8B).

The toggle 44 may comprise a polymeric material, Thermoplastic Polyurethane (TPU) material or another suitable material. The toggle 44 may be a spring-loaded toggle 44, wherein an internal spring element causes the toggle 44 to mechanically engage the adjustable lace 42 or a non-spring-loaded toggle 44 that is simply frictionally engaged with the adjustable lace 42.

Figure 5:
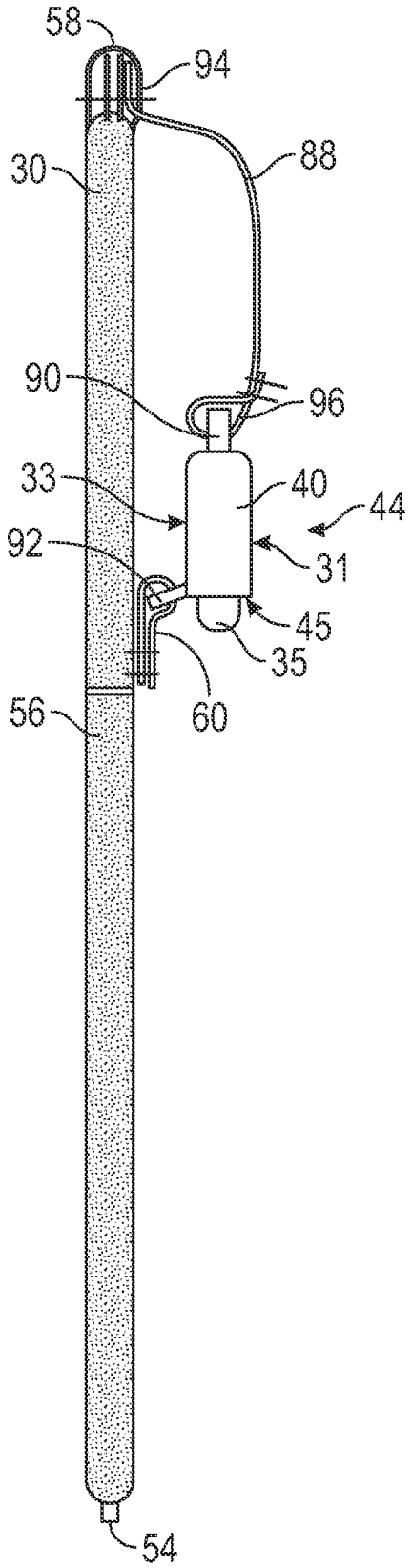
FIG. 5 is a schematic side-view of the tongue and the toggle of an example closure mechanism.
Figure 6A:
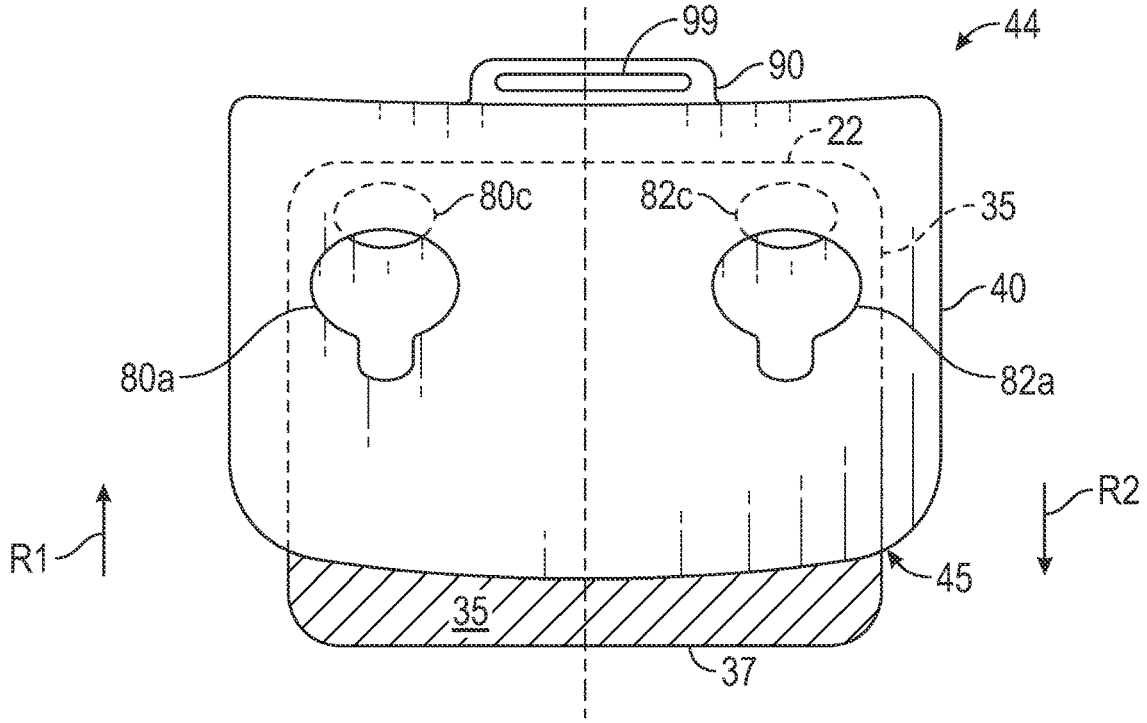
FIG. 6A is a schematic elevation view of an example toggle in the clinched position.
Figure 6B:
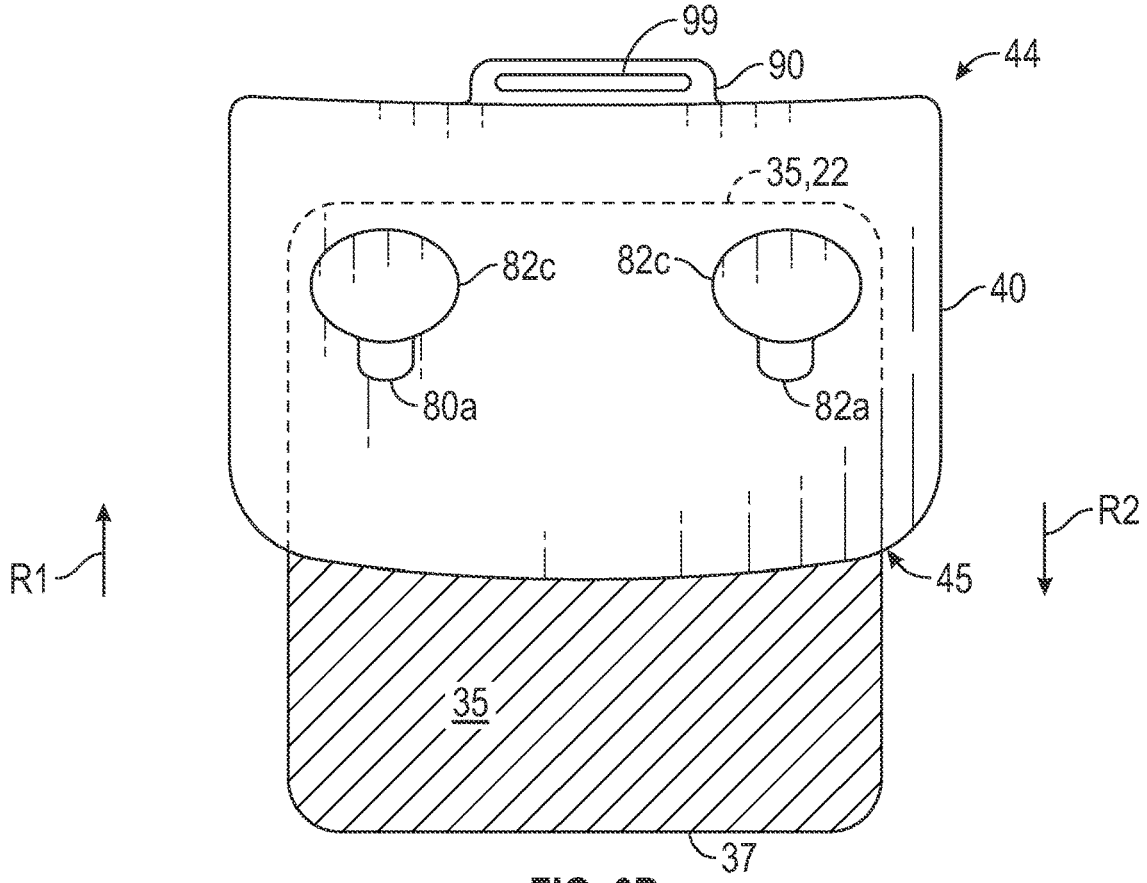
FIG. 6B is a schematic elevation view of an example toggle in the moveable position.

As best shown in FIGS. 5-6B, in one embodiment, the toggle 44 comprises a base unit 40 having a base unit first portion 31 defining a toe facing surface and a base unit second portion 33 defining a tongue facing surface. The base unit 40 may further define an interior slot 45 between the base unit first portion 31 and the base unit second portion 33. A tether attachment flange 90 may extend from the base unit 40 and may further define a tether attachment flange receiving bore 99. A tongue attachment flange 92 may extend from the tongue facing surface of the base unit second portion 33 toward the tongue 30 and may further define a tongue attachment flange receiving bore 99. Each of the tether attachment flange 90 and the tongue attachment flange 92 may be formed of a substantially similar material to that of the base unit 40.

The base unit first portion 31 may further define a first plurality of apertures 80*a*, 82*a*. The base unit second portion 33 may further define a substantially similar second plurality of apertures 80*b*, 82*b*. The adjustable lace 42 may be received by the apertures 80*a*, 80*b*, 82*a*, 82*b*. such that the toggle 44 is operatively coupled to and slidable along the adjustable lace 42. The apertures 80*a*, 80*b*, 82*a*, 82*b* may be from about 2.0 millimeters to about 5.0 millimeters or more in diameter. In some embodiments, the apertures 80*a*, 80*b*, 82*a*, 82*b* may be from about 2.5 millimeters in diameter to about 3.5 millimeters in diameter. In embodiments wherein the toggle 44 is a spring-loaded toggle 44, the diameter of the respective apertures 80*a*, 80*b*, 82*a*, 82*b* may be enlarged to the higher end of the range, e.g., from about 3.5 millimeters to about 5.0 millimeters, such that the aperture 80*a*, 80*b*, 82*a*, 82*b* does not impinge the adjustable lace 42, but allows the internal spring element of the spring-loaded toggle to position relative components to mechanically engage and disengage. This larger diameter of the apertures

80*a*, 80*b*, 82*a*, 82*b* coupled with the stretchable nature of the adjustable lace 42 allows the toggle 44 to be easily moveable along the adjustable lace 42. In still other embodiments, the apertures 80*a*, 80*b*, 82*a*, 82*b* may have an even larger diameter to accommodate for a larger gauge cable lace.

The toggle 44 may further include a slot member 35 having a first end 37 and a second end 22. The slot member 35 defines a third plurality of apertures 80*c*, 82*c* also configured to receive the adjustable lace 42. The slot member 35 may be slidably mounted in an interior slot 45, such that the first end 37 extends outside of the base unit 40 and the second end 22 extends into the slot 45 between the base unit first portion 31 and the base unit second portion 33. In the example embodiment wherein the toggle 44 is a spring-loaded toggle 44, the toggle 44 may further include a spring element disposed in the interior slot 45 that contacts the slot member second end 22, which urges the slot member 35 out of the slot 45.

Said another way, the toggle 44 occupies at least one of a clinched position (FIG. 6A) and a moveable position (FIG. 6B). When the toggle 44 occupies the clinched position (FIG. 6A), the toggle 44 is clinched onto the adjustable lace 42, due to a misalignment the apertures 80*c*, 82*c* with apertures 80*a*, 80*b*, 82*a*, 82*b*, such that the adjustable lace 42 is pinched within and between the first portion 31, the slot member 35, and the second portion 33 within the interior slot 45. The pinching of the adjustable lace 42 within the interior slot 45, thereby locks the toggle 44 in place on the adjustable lace 42. Said another way, in the clinched position, the third plurality of toggle apertures 80*c*, 82*c* are positioned in a first plane and each of the first plurality of toggle apertures 80*a*, 82*a* and the second plurality toggle apertures 80*b*, 82*b* are positioned in a second plane that is parallel to but spaced apart from the first plane.

When the toggle 44 occupies the moveable position (FIG. 6B), the toggle 44 is moveable along the adjustable lace 42. The toggle 44 is transitioned from the clinched position (FIG. 6A) to the moveable position (FIG. 6B), when an external force is applied to at least one of the slot member second end 22 or the third plurality of apertures 80*c*, 82*c* in a direction R2, such that the slot member 35 reaches the bottom of its range of slidable motion within the slot 45. When external force is applied to at least one of the slot member 35 at the second end 22 or the third plurality of apertures 80*c*, 82*c* in a direction R2, each of the first plurality of toggle apertures 80*a*, 82*a*, the second plurality toggle apertures 80*b*, 82*b*, and the third plurality of toggle apertures 80*c*, 82*c* are each positioned in the second plane and aligned with one another, so as to yield a pair of openings extending through the entire toggle 44, whereby the adjustable lace 42 may move within the respective apertures through an aligned unit 40 (FIG. 6B).

As shown in FIGS. 1, 2, 5, 8A-8D, and 10A-10C, in one example embodiment, the toggle 44 may be coupled to the tongue body 56. In such examples, the toggle 44 may be coupled to the tongue body 56 via a tongue attachment feature 60. The tongue attachment feature 60 may be permanently fixed, by stitching either directly or indirectly, to the tongue body 56 and may be operatively coupled to the toggle 44 at the tongue attachment flange 92. The tongue attachment feature 60 may be formed from a textile, leather, polymeric, or similar material, and may further be defined as a strip of material or a loop of material operatively attached to each of the tongue body 56 and toggle 44.

The closure mechanism 32 may further include a tether 88 operatively coupled to the tongue distal edge 58 at a first tether attachment point 94 and operatively coupled to the toggle 44 at a second tether attachment point 96 positioned on the tether attachment flange 90. The tether 88 may be formed from a textile, leather, polymeric, or similar material, and may further be defined as a strip of material or a loop of material operatively attached to each of the tongue distal end 58 and toggle 44. The tether 88 may have a frictional coating 65 applied thereto to enhance the grip characteristics of the tether 88. The first tether attachment point 94 on the tongue distal edge 58 and the second tether attachment point 96 on the tether attachment flange 90 are each positioned on the longitudinal midline LM. The tether 88 is designed to form an easily graspable half loop, which is capable of receiving two or more human fingers. In this way, the first tether attachment point 94 is spaced apart from the second tether attachment point 96 on the longitudinal midline LM by at least 1.50 centimeters. Sizing the tether 88, such that the tether 88 is capable of receiving two or more human fingers limits fine motor use of the hands and fingers necessary to engage the tether 88.

Referring to FIGS. 8A-8D and 10A-10C, the toggle 44 is operatively coupled to and movable along the adjustable lace 42 between a first position 300 on the adjustable lace 42 and a second position 400 on the adjustable lace 42. In some embodiments, the first position 300 on the adjustable lace 42 and the second position 400 on the adjustable lace 42 may be marked by an application of frictional coating 65 applied to the adjustable lace 42 in a frictional coating zone that denotes the respective position 300, 400 (FIG. 8B). The frictional coating 65 may be designed to assist in holding the toggle 44 in the respective position 300, 400, when the toggle occupies the clinched position within the frictional coating zone denoting the first position 300 or the second position 400. In applications for children's shoes, the frictional coating may be of a color that is different than the color of the adjustable lace 42. In this way, the child may understand the preferred first position 300 of the toggle 44 on the adjustable lace 42 indicating the footwear is in the open position 100 and the preferred second position 400 of the toggle 44 on the adjustable lace 42 indicating the footwear 10 is in the tightened position 200. Such visual indicators may also be of use to parents, teachers, and other caregivers in order to quickly visually ascertain if the footwear 10 is secured to the wearer's foot in the tightened position 200.

When the toggle 44 occupies the first position 300 on the adjustable lace 42 (FIGS. 8A, 10B, 10C) the article of footwear 10 is in an open position 100, which permits entry and removal of a foot of a wearer into the interior volume 16 defined by the lateral side portion 24 and the medial side portion 26 of the upper 12. When the toggle 44 occupies the second position 400 on the adjustable lace 42 the article of footwear 10 is in a tightened position 200, which secures the foot of the wearer in the interior volume 16.

Figure 10B:
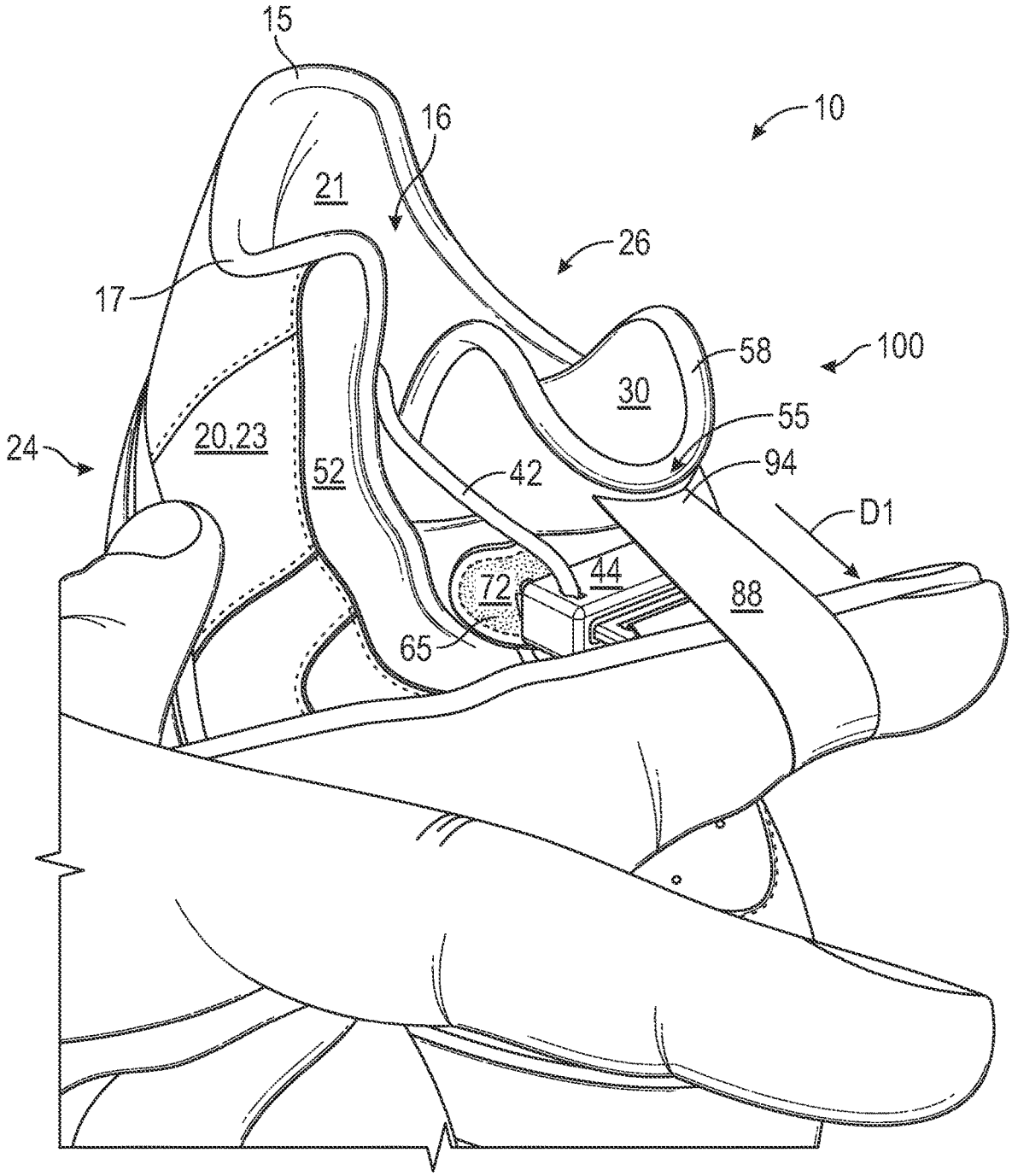
FIG. 10B a perspective top view of the example embodiment of FIG. 3, wherein the toggle is in the first position on the adjustable lace and the example shoe is in the open position after the traction force is applied to the tether.
Figure 10C:
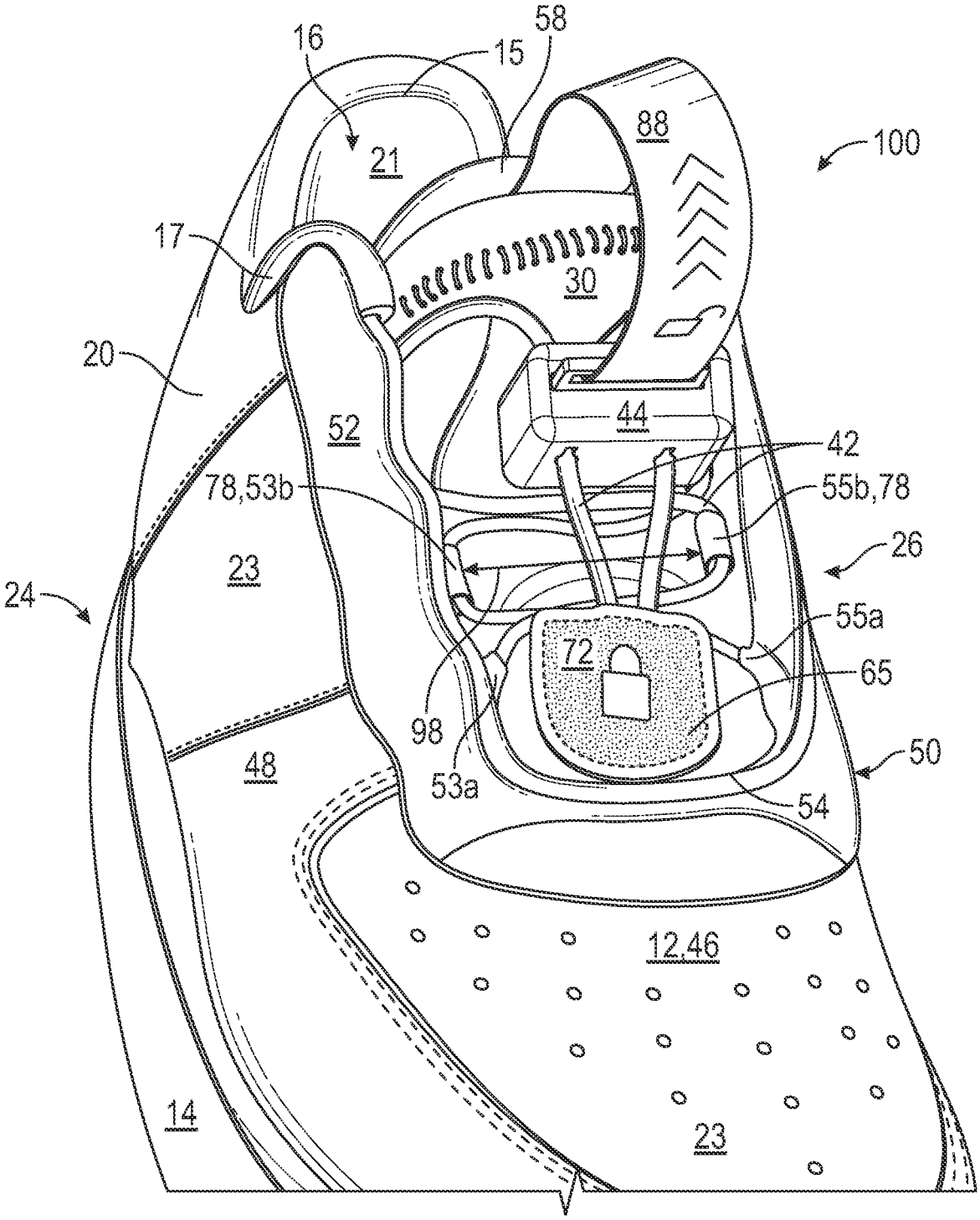
FIG. 10C is a perspective top view of the example embodiment of FIG. 3, wherein the toggle is in the first position on the adjustable lace and the example shoe is in the open position, with the pull tab being fastened to the tongue via the coupling feature.

As illustrated in FIGS. 10B and 10C, when the article of footwear is in the open position 100, such that the toggle 44 occupies the first position 300, a maximum distance 98 across the throat opening 28 from the lateral sidewall portion 24 to the medial sidewall portion 26 is greater than the maximum distance 98 across the throat opening 28 from the lateral sidewall portion 24 to the medial sidewall portion 26 when the toggle 44 occupies the second position 400 and the article of footwear is in the tightened position 200. As illustrated further illustrated in FIGS. 10A, the loop end 74 of the third lateral guide element 53*c* and the loop end 74 of the third medial guide element 55*c* are each positioned on an alignment axis A (FIG. 10A) that is substantially orthogonal to the longitudinal midline LM. When the toggle 44 occupies the second position 400 on the adjustable lace 42, the toggle 44 is disposed on the alignment axis A and substantially bisected thereby, such that the loop end 74 of the third lateral guide element 53*c*, the loop end 74 of the third medial guide element 55*c*, and the toggle 44 are all substantially aligned with each other on the alignment axis A and substantially orthogonal to the longitudinal midline LM. Said another way, the toggle 44 and the apertures 80*a*, 80*b*, 80*c*, 82*a*, 82*b*, 82*c* defined therein are disposed at an angle of about 180 degrees from the loop end 74 of the third lateral guide element 53*c* and the loop end 74 of the third medial guide element 55*c* respectively.

The closure mechanism 32 of the present disclosure is designed to facilitate ease of use for the wearer with a single motion, one-handed, transition from an open position 100 to a tightened position 200 as well as a single motion, one-handed, transition from the tightened position 200 to the open position 100. In the simplest sense, transitioning the article of footwear 10 from the open position 100 to the tightened position 200 is facilitated by a single motion, one-handed, application of a traction force upon the pull tab 72 in a predetermined direction D1 (FIGS. 8A-8D) and transitioning the article of footwear 10 from the tightened position 200 to the open position 100 is facilitated by a single motion, one-handed, application of a traction force upon the tether 88 in the predetermined direction D1 (FIGS. 10A-10C). Due to the positioning of the guide loops 78 of the third lateral guide element 53*c* and the third medial guide element 55*c*, traction force may be applied to the pull tab 72 and the tether 88 in any predetermined direction D1. Said another way, the predetermined direction D1 of the traction force may be any direction away from the upper 12, for example, at 45 degrees from the toggle 44, at 90 degrees from the toggle 44 (as shown in FIGS. 8A-8D and 10A-10C), or in another outward direction.

More particularly, moving the toggle 44 from the first position 300 on the adjustable lace 42 to the second position 400 on the adjustable lace 42 is facilitated by a single motion, one-handed, application of a traction force upon the pull tab 72 in the predetermined direction D1. When the article of footwear 10 is in the open position 100, the toggle 44 is locked in a clinched state (FIG. 6A) in the first position 300 on the adjustable lace 42. In this way, when the toggle 44 is in the clinched position in the first position 300 on the adjustable lace 42, the adjustable lace 42 is pinched between the first portion 31, the second portion 33, and the slot member 35 of the toggle 44, as the third plurality of toggle apertures 80*c*, 82*c* are misaligned with the first plurality of toggle apertures 80*a*, 82*a* and the second plurality toggle apertures 80*b*, 82*b*.

Moving the toggle 44 from the first position 300 on the adjustable lace 42 to the second position 400 on the adjustable lace 42, is facilitated via a traction force on the pull tab 72. Applying a traction force to the pull tab 72 causes the adjustable lace 42 housed within the plurality of apertures 80*a*, 82*a*, 80*b*, 82*b*, 80*c*, 82*c* to exert an external force on the slot member 35, in the direction R2, at the apertures 80*c* and 82*c*, such that the slot member 35 reaches the bottom of its range of slidable motion, such that the third plurality of toggle apertures 80*c*, 82*c* are aligned with each of the first plurality of toggle apertures 80*a*, 82*a* and the second plurality toggle apertures 80*b*, 82*b*, so as to yield a pair of openings extending through the entire toggle 44, whereby the adjustable lace 42 may move within the respective apertures 80*a*, 82*a*, 80*b*, 82*b*, 80*c*, 82*c* through an aligned unit 40. In this way, when each of the first plurality of toggle apertures 80*a*, 82*a* and the second plurality toggle apertures 80*b*, 82*b*, and third plurality of toggle apparatus 80*c*, 82*c* are aligned with each other, the toggle 44 occupies a moveable position (FIG. 6B).

Applying a traction force to the pull tab 72 further causes the adjustable lace 42 to stretch, which in turn decreases the diameter of the adjustable lace 42 facilitating an ease of motion of the adjustable lace 42 through the guide loops 53*a*, 53*b*, 53*c*, 55*a*, 55*b*, 55*c* and the apertures 80*a*, 80*b*, 80*c*, 82*a*, 82*b*, 82*c*. Further, the stretchable properties of the adjustable lace 42 allows the user to produce the required external force in the second direction R2 at the apertures 80*c* and 82*c* with less required traction force in the direction D1, which is further beneficial to wearers having limited mobility and dexterity. As the adjustable lace 42 moves through the apertures 80*a*, 80*b*, 80*c*, 82*a*, 82*b*, 82*c* and the guide loops 53*a*, 53*b*, 53*c*, 55*a*, 55*b*, 55*c* in response to the traction force applied to the pull tab 72, the adjustable lace 42 imparts tension in each of the lateral sidewall portion 24 and the medial sidewall portion 26, when a foot is within the interior volume 16. Said another way, moving the toggle 44 from the first position 300 on the adjustable lace 42 to the second position 400 on the adjustable lace 42 operatively reduces the size of the ankle opening 15.

Moving the toggle from the second position 400 on the adjustable lace 42 to the first position 300 on the adjustable lace 42 is facilitated by a single motion, one-handed, application of a traction force upon the tether 88 in the predetermined direction D1. When the article of footwear 10 is in the tightened position 200, the toggle 44 is locked in a clinched state (FIG. 6A) in the second position 400 on the adjustable lace 42. In this way, when the toggle 44 is in the clinched position in the second position 400 on the adjustable lace 42, such that the adjustable lace 42 is pinched between the first portion 31, the second portion 33, and the slot member 35 of the toggle 44, as the third plurality of toggle apertures 80*c*, 82*c* are misaligned with the first plurality of toggle apertures 80*a*, 82*a* and the second plurality toggle apertures 80*b*, 82*b*.

Moving the toggle 44 from the second position 400 on the adjustable lace 42 to the first position 300 on the adjustable lace 42, is facilitated via a traction force on the tether 88. Applying a traction force to the tether 88 causes the tether 88 to exert an external force on the base unit 40 in the first direction R1 and the adjustable lace 42 housed within the plurality of apertures 80*a*, 82*a*, 80*b*, 82*b*, 80*c*, 82*c* to exert an external force on the slot member 35, in the direction R2, at the apertures 80*c* and 82*c*, such that the slot member 35 reaches the bottom of its range of slidable motion and the third plurality of toggle apertures 80*c*, 82*c* is aligned with each of the first plurality of toggle apertures 80*a*, 82*a* and the second plurality toggle apertures 80*b*, 82*b*, so as to yield a pair of openings extending through the entire toggle 44, whereby the adjustable lace 42 may move within the respective apertures 80*a*, 82*a*, 80*b*, 82*b*, 80*c*, 82*c* through an aligned unit 40. In this way, when each of the first plurality of toggle apertures 80*a*, 82*a* and the second plurality toggle apertures 80*b*, 82*b*, and third plurality of toggle apparatus 80*c*, 82*c* are aligned with each other, the toggle 44 occupies a moveable position (FIG. 6B). Further, the stretchable properties of the adjustable lace 42 allows the user to produce the required external force in the direction R2 at the apertures 80*c* and 82*c* with less required traction force on the tether 88, which is further beneficial to wearers having limited mobility and dexterity.

The tether 88 is further operatively coupled to the tongue 30 at the distal edge 58, and the tether 88 is further coupled to the toggle base unit 40 at the tether attachment flange 90.

Accordingly, the tether 88 is operatively coupled to the tongue distal edge at a first tether attachment point 94 and operatively coupled to the toggle 44 at the second tether attachment point 96. The first tether attachment point 94 and the second tether attachment point 96 are spaced apart, such that the tether 88 forms a loop capable of receiving two or more human fingers (FIGS. 3, 5, and 10A-10C). The toggle 44 is further attached to the tongue body 56 at the tongue attachment feature 60. As such, the tether 88 is operatively coupled to the tongue 30 at each of the tongue distal edge 58 and the tongue body 56.

As a result of the tether 88 being operatively coupled to the tongue distal edge 58 and the toggle 44 being operatively coupled to the tongue body 56, applying a traction force to the tether 88 further causes the tongue 30 to be drawn forward and away from the ankle opening 15, such that the tongue distal edge 58 and the tongue body 56 are disposed above the throat opening 28 (FIG. 10B). As the tongue 30 and the toggle 44 are drawn away from the ankle opening 15 the maximum size of the ankle opening 15 is increased, as the adjustable lace 42 moves through the apertures 80*a*, 80*b*, 80*c*, 82*a*, 82*b*, 82*c*, and thereby transitions the article of footwear from the tightened position 200 to the open position 100 to allow for entry and or removal of the foot from the interior volume 16.

The single motion, one-handed, application of a traction force upon the pull tab 72 to tighten and upon the tether 88 to release the closure mechanism 32 allows wearer's having limited dexterity or mobility, which causes difficulties in tying or otherwise securing traditional shoe laces or other closure mechanisms, to tighten and release their own footwear 10 with ease, as the closure mechanism 32 of the present invention requires only limited fine motor movement in the hands and fingers, as well as limited amount of required traction force to transition the footwear between an open position 100 and a tightened position 200. The single motion, one-handed, application of the traction force upon the pull tab 72 to tighten and upon the tether 88 to release the closure mechanism 32 also allows parents, teachers, guardians, and other caregivers to secure and/or remove the footwear from a patient, young, child, or other charge in a single motion, with limited effort, and the use of only one hand. In applications for children's shoes, visual indicators of the position of the footwear in the open position 100 or tightened position 200, may also be of use to parents, teachers, and other caregivers in order to quickly visually ascertain if the footwear 10 is secured to the wearer's foot.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Benefits, other advantages, and solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

What is claimed is:

1. A closure mechanism for adjusting a size of an ankle opening of a footwear upper, the footwear upper defining an interior volume and the ankle opening permitting access to the interior volume, the closure mechanism comprising:

an adjustable lace couplable to the footwear upper;

a toggle configured such that the adjustable lace is slidable through the toggle to move the toggle between a first position on the adjustable lace and a second position on the adjustable lace; and a tether fixable to a tongue of the footwear upper at a first tether attachment point and fixed to the toggle at a second tether attachment point;

wherein the toggle includes a base unit having:

a body;

a tether attachment flange extending from a side of the body with the second tether attachment point on the tether attachment flange; and a tongue attachment flange extending from another side of the body orthogonal to the side of the body from which the tether attachment flange extends and operatively securable to the tongue.

2. The closure mechanism of claim 1, wherein moving the toggle from the first position on the adjustable lace to the second position on the adjustable lace operatively reduces a size of the ankle opening; and wherein moving the toggle from the second position on the adjustable lace to the first position on the adjustable lace operatively increases the size of the ankle opening.

3. The closure mechanism of claim 2, wherein application of a traction force on the adjustable lace in a predetermined direction moves the toggle from the first position on the adjustable lace to the second position on the adjustable lace, and application of a traction force on the tether in the predetermined direction moves the toggle from the second position on the adjustable lace to the first position on the adjustable lace.

4. The closure mechanism of claim 1, further comprising:

a pull tab operatively coupled to the adjustable lace.

5. The closure mechanism of claim 4, wherein pulling the pull tab slides the adjustable lace through the toggle to move the toggle from the first position to the second position.

6. The closure mechanism of claim 4, further comprising:

a fastener configured to selectively couple the pull tab to the footwear upper.

7. The closure mechanism of claim 6, wherein the fastener comprises a hook and loop fastener.

8. The closure mechanism of claim 1, wherein the toggle is a spring-loaded toggle mechanically engaged with the adjustable lace.

9. The closure mechanism of claim 1, wherein the toggle is frictionally engaged with the adjustable lace.

10. The closure mechanism of claim 1, wherein the adjustable lace comprises a first color at the first position and a second color different than the first color between the first position and the second position.

11. The closure mechanism of claim 1, wherein:

the base unit has an interior slot;

the toggle includes a slot member movable within the interior slot; and the adjustable lace is engaged with the toggle between the base unit and the slot member.

12. The closure mechanism of claim 11, further comprising:

a spring element disposed in the interior slot and urging the slot member out of the interior slot.

13. The closure mechanism of claim 11, wherein:

the base unit has a first surface and an opposite second surface;

the base unit has a first plurality of apertures in the first surface and in communication with the interior slot;

the base unit has a second plurality of apertures in the second surface and in communication with the interior slot;

the second plurality of apertures is aligned with the first plurality of apertures; and the adjustable lace extends through the first plurality of apertures and through the second plurality of apertures.

14. The closure mechanism of claim 13, wherein:

the base unit has an opening at the interior slot in a surface extending between the first surface and the second surface; and the slot member extends out of the opening.

15. The closure mechanism of claim 13, wherein:

the slot member has a third plurality of apertures extending therethrough; and the adjustable lace further extends through the third plurality of apertures.

16. The closure mechanism of claim 15, wherein:

the third plurality of apertures is at least partially aligned with the first plurality of apertures and with the second plurality of apertures when the toggle is moving between the first position and the second position, and is out of alignment with the first plurality of apertures and with the second plurality of apertures when the toggle is in the first position and when the toggle is in the second position.

17. The closure mechanism of claim 13, wherein the apertures of the first plurality of apertures have a keyhole shape.

18. The closure mechanism of claim 1, wherein:

the body defines an interior slot with an opening at an outer surface of the body; and the side of the body from which the tether attachment flange extends is opposite from the outer surface of the body having the opening of the interior slot.

19. The closure mechanism of claim 1, further comprising:

a strip of material configured to extend through the tongue attachment flange to couple the toggle to the footwear upper.

20. The closure mechanism of claim 1 in combination with the footwear upper, wherein the first tether attachment point on the tongue and the second tether attachment point on the tether attachment flange are each positionable on a longitudinal midline of the footwear upper.

* * * * *